US007476495B2

(12) United States Patent
Kikuchi et al.

(10) Patent No.: US 7,476,495 B2
(45) Date of Patent: Jan. 13, 2009

(54) SILVER HALIDE PHOTOSENSITIVE MATERIAL AND IMAGE FORMING METHOD USING THE SAME

(75) Inventors: Tetsuo Kikuchi, Minamiashigara (JP); Yoichi Hosoya, Minamiashigara (JP); Masaaki Miki, Minamiashigara (JP); Junichiro Hosokawa, Minamiashigara (JP); Koichi Yokota, Minamiashigara (JP); Ryoji Nishimura, Minamiashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/905,114

(22) Filed: Sep. 27, 2007

(65) Prior Publication Data

US 2008/0081300 A1 Apr. 3, 2008

(30) Foreign Application Priority Data

Sep. 29, 2006 (JP) ..... 2006-269820
Mar. 30, 2007 (JP) ..... 2007-094215

(51) Int. Cl.

| | |
|---|---|
| ***G03C 1/46*** | (2006.01) |
| ***G03C 1/08*** | (2006.01) |
| ***G03C 1/005*** | (2006.01) |
| ***G03C 1/494*** | (2006.01) |

(52) U.S. Cl. ..... 430/502; 430/503; 430/504; 430/505; 430/506; 430/508; 430/509; 430/570; 430/572; 430/576; 430/581; 430/583; 430/585

(58) Field of Classification Search ..... 430/502–506, 430/508, 509, 570, 572, 576, 581, 583, 585
See application file for complete search history.

(56) References Cited

U.S. PATENT DOCUMENTS 5,413,902 A * 5/1995 Hara et al. ..... 430/503

* cited by examiner

*Primary Examiner*—Geraldina Visconti
(74) *Attorney, Agent, or Firm*—Birch, Stewart, Kolasch & Birch, LLP

(57) ABSTRACT

A silver halide photosensitive material comprising at least one blue-sensitive layer, at least one green-sensitive layer and at least one red-sensitive layer on a transparent support, wherein a peak wavelength of spectral sensitivity of at least one of the green-sensitive layer is in the range of −10 nm or more and +10 nm or less in comparison with a peak wavelength of a green light source for exposure.

17 Claims, 1 Drawing Sheet

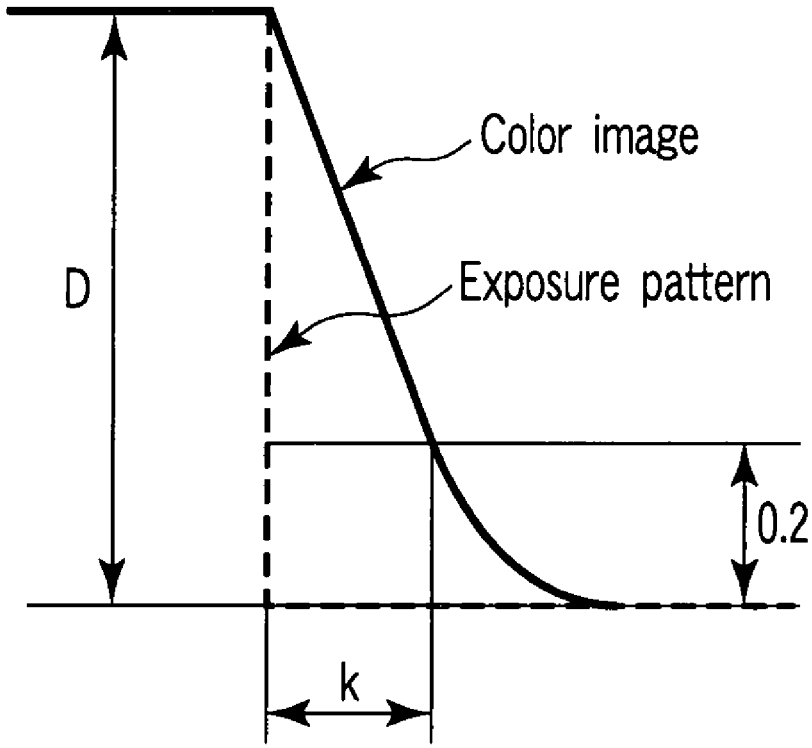
FIGURE

SILVER HALIDE PHOTOSENSITIVE MATERIAL AND IMAGE FORMING METHOD USING THE SAME

CROSS-REFERENCE TO RELATED APPLICATIONS

This application is based upon and claims the benefit of priority from prior Japanese Patent Applications No. 2006-269820, filed Sep. 29, 2006; and No. 2007-094215, filed Mar. 30, 2007, the entire contents of both of which are incorporated herein by reference.

BACKGROUND OF THE INVENTION

1. Field of the Invention

The present invention relates to a silver halide photosensitive material capable of recording digital image information without deterioration and an image forming method using the same.

2. Description of the Related Art

The preparation of a film for screening has conventionally applied a method of using image information captured using a negative film for photography as a source image, preparing a copy by printing it on an intermediate film and further printing this on a positive film to be provided for projection.

In many cases, the intermediate film for preparation of a copy is used twice. The negative source film is printed on a negative intermediate film for preparing a master positive. Then, the master positive is printed again on the intermediate film for preparing duplicate negative. The duplicate negative is finally printed on a positive film for screening.

In the preparation of a film for screening, there has recently prevailed a process of carrying out the digital synthesis and editing of the source image and converting it on a film as an analogue image again by a film recorder. This is carried out because images impossible in reality are prepared by synthesis and editing by a computer and the freedom of image representation can be expanded. As the source image, there can be used various images such as image information obtained by digitizing image information photographed on a negative film for photographing by a film scanner, image information photographed by an HD video camera and image information obtained by computer graphics.

When the source image is prepared as digital information in good convenience as described above and this is screened by conventional analog screening, there is applied a process of printing the source prepared as digital information on an intermediate film and printing this on a positive film for screening in a similar manner as a conventional process.

However, when the process is applied, a new problem is generated in accordance with the high resolution of digital information. When original image is printed on a silver halide photosensitive material, there has been a problem that the deterioration of image quality occurs and adequate screening image quality is not kept. There has been required the improvement of the deterioration of image quality performances such as the generation of blotting, the deterioration of sharpness and the lowering of color reproducibility that originate in the photographic properties of an analog silver halide photosensitive material. Jpn. Pat. Appln. KOKAI Publication No. (hereinafter referred to as JP-A-)62-284344 indicates that color mixing is little and granularity and resolution are improved by matching the peak wavelength of spectral sensitivity of the green photosensitive emulsion layer of a silver halide color photosensitive material with 514.5 nm of the wavelength of argon (Ar) laser, in picture recording by laser using 514.5 nm of the wavelength of argon (Ar) laser as a green light source.

However, the above-mentioned Patent Document 1 does not provide description concerning image recording with high resolution. Furthermore, a green light source device recently used in the field of preparing a film for screening is small-sized and power saving, and thus solid laser is main stream and its wavelength is 532.0 nm. Therefore, the silver halide photosensitive material described in Patent Document 1 is clearly unsuitable for recording fine digital image information. Consequently, there has been intensively desired a silver halide photosensitive material capable of recording digital image information with little deterioration.

BRIEF SUMMARY OF THE INVENTION

It is an object of the invention to record digital information on a silver halide photosensitive material at high resolution and with little deterioration.

Here, the recording with little deterioration in the invention means that the loss of image structure at recording that is contained in the digital image information is suppressed to be little and further, that the change of color information at recording is suppressed to be little.

The object of the invention can be attained by the following.

(1) A silver halide photosensitive material comprising at least one blue-sensitive layer, at least one green-sensitive layer and at least one red-sensitive layer on a transparent support, wherein a peak wavelength of spectral sensitivity of at least one of the green-sensitive layer is in the range of −10 nm or more and +10 nm or less in comparison with a peak wavelength of a green light source for exposure.

(2) The silver halide photosensitive material according to (1), wherein the green light source for exposure is a solid laser, and the peak wavelength of spectral sensitivity of at least one of the green-sensitive layer is in the range of −10 nm or more and +10 nm or less in comparison with a peak wavelength of the solid laser.

(3) The silver halide photosensitive material according to (1) or (2), wherein a peak wavelength of spectral sensitivity of at least one of the blue-sensitive layer is in the range of −10 nm or more and +10 nm or less in comparison with a peak wavelength of a blue light source for exposure.

(4) The silver halide photosensitive material according to any one of (1) to (3), wherein a peak wavelength of spectral sensitivity of at least one of the red photosensitive layer is in the range of −10 nm or more and +10 nm or less in comparison with a peak wavelength of a red light source for exposure.

(5) A silver halide photosensitive material comprising at least one blue-sensitive layer, at least one green-sensitive layer and at least one red-sensitive layer on a transparent support, wherein a compound represented by the following general formula (A) and a compound represented by the following general formula (B) are contained in at least one of the green-sensitive layer:

General formula (A)

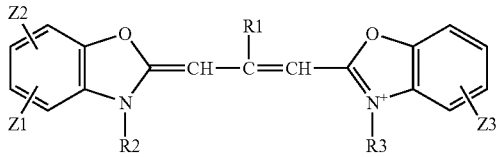

(X1)

General formula (B)

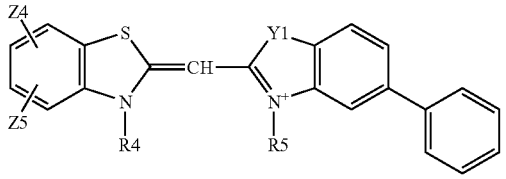

(X2)

in the general formula (A), R1 represents a hydrogen atom, an alkyl group or an aryl group; each of R2 and R3 represents an alkyl group; each of Z1 and Z2 represents a hydrogen atom, a halogen atom, a hydroxyl group, an alkoxy group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, Z1 and Z2 may be the same substituent or may be different substituents, and Z1 and Z2 may be bonded to each other to thereby form a ring; Z3 represents a halogen atom; and X1 represents a cationic counter ion for neutralizing electric charge if necessary;

in the general formula (B), Y1 represents sulfur or an oxygen atom; each of R4 and R5 represents an alkyl group; each of Z4 and Z5 represents a hydrogen atom, a halogen atom, a hydroxyl group, an alkoxy group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, Z4 and Z5 may be the same substituent or may be different substituents, and Z4 and Z5 may be bonded to each other to thereby form a ring; and X2 represents a cationic counter ion for neutralizing electric charge if necessary.

(6) The silver halide photosensitive material according to (5), wherein the molar ratio of the compound represented by the general formula (A) to the compound represented by the general formula (B) contained in the green-sensitive layer satisfies the following formula (II):

$$0.5 \leqq [A]/[B] \leqq 2.0 \quad \text{(II)}$$

where [A] and [B] represents the number of moles (mol/mol Ag) of the compounds represented respectively by the general formulae (A) and (B) per mole of silver halide that is contained in the green-sensitive layer in which the compounds represented by the general formulae (A) and (B) are contained.

(7) The silver halide photosensitive material according to (5) or (6), wherein the shape of silver halide grains contained in the green-sensitive layer containing the compounds represented by the general formulae (A) and (B) is cubic.

(8) The silver halide photosensitive material according to any one of (1) to (7), wherein digital image information can be recorded with little deterioration at image formation in which the digital image information is recorded at a resolution of 2000 dpi or more.

(9) The silver halide photosensitive material according to any one of (1) to (8), wherein digital image information with 3 million or more pixels can be recorded with little deterioration.

(10) The silver halide photosensitive material according to any one of (1) to (9), wherein blotting k of the image at image recording satisfies the following formula (I):

$$k \leqq 4.5 \times (D-0.2)^2 \quad \text{(I)}$$

in formula (I);

D: Color density of the silver halide photosensitive material,

Blotting k: blotting (μm) at color density D.

(11) The silver halide photosensitive material according to any one of (1) to (10), wherein color purity rate is 80% or more in color reproduction at image recording.

(12) An image forming method, wherein digital image information recorded in the silver halide photosensitive material according to any one of (1) to (11) is further recorded on the silver halide photosensitive material by an analog system.

BRIEF DESCRIPTION OF THE SEVERAL VIEWS OF THE DRAWING

The single FIGURE is a schematic diagram for explaining blotting k in the invention.

DETAILED DESCRIPTION OF THE INVENTION

The invention will be specifically described. "The peak wavelength of spectral sensitivity" in the invention means wavelength at which the maximum value of the spectral sensitivity of a spectral sensitivity spectrum curve is shown. The spectral sensitivity spectrum curve is obtained by exposing the silver halide photosensitive material using, for example, the device of isoenergetic spectrum meter (Fuji Photo Film Co., Ltd.).

The light source used in the invention will be described. Various light sources such as an incandescent lamp, a fluorescent lamp, laser light and sunlight exist but the light source used in the invention is preferably laser light. A solid-state laser in which medium is solid is preferably used for a green light source. For example, a ruby laser in which chromium ions are mixed in sapphire crystal and YAG laser in which neodymium ion is mixed in yttrium-aluminum-garnet crystal (YAG) are preferably used. YAG laser will be specifically described. It oscillates infrared light having a wavelength of 1064 nm. The wavelength (1064 nm) can be converted to 532 nm that is a half (second higher harmonic) and to 355 nm that is one third (third higher harmonic) by using it in combination with non-linear optical crystal. As a blue light source and a red light source, semiconductor laser in which medium is a semiconductor is preferably used.

General relation between the peak wavelength of a light source for exposure and the peak wavelength of spectral sensitivity of the silver halide photosensitive material will be described. When the exposure quantity of the light source for exposure is increased, distribution width is broadened and noise is also generated. Accordingly, the blotting is enlarged and can be recognized as the deterioration of sharpness. In particular, when character image and fine image are exposed, the problem is easily generated. Therefore, the exposure quantity must be controlled to such an extent that the blotting is negligible. Further, in particular, when the laser light source is used, the increase in the blotting relative to exposure quantity is great, and thus the exposure quantity is further limited.

Accordingly, it is preferable from the viewpoints of the blotting and sharpness that the peak wavelength of a light source is matched with the peak wavelength of spectral sensitivity of the silver halide photosensitive material as much as possible.

Namely, the exposure quantity of a light source can be suppressed by setting the peak wavelength of spectral sensitivity of the silver halide photosensitive material as no more than ±10 nm, more preferably no more than ±7 nm, further preferably no more than ±5 nm and most preferably no more than ±1 nm in comparison with the peak wavelength of the light source. Therefore, recording with little blotting that is superior in sharpness and has the little deterioration of digital image information can be carried out.

It is important how spectral sensitization is carried out by a sensitization dye contained in the silver halide photosensitive material so that the peak wavelength of spectral sensitivity of the silver halide photosensitive material is set as no more than ±10 nm, more preferably no more than ±7 nm, further preferably no more than ±5 nm and most preferably no more than ±1 nm in comparison with the peak wavelength of the light source for exposure.

The sensitization dye used in the invention will be described in detail below.

It is preferable for exhibiting the effect of the invention that the photosensitive emulsion of the invention is spectrally sensitized by methine dyes and others. The dyes used include a cyanine dye, a mellocyanine dye, a complex cyanine dye, a complex mellocyanine dye, a holopolarcyanine dye, a hemicyanine dye, a styryl dye and a hemioxonol dye. Particularly effective are the dyes belonging to the cyanine dye, mellocyanine dye, and complex mellocyanine dye. Any of nuclei usually utilized for cyanine dyes as basic heterocyclic nuclei can be adapted for these dyes. Namely, there can be adapted pyrroline nucleus, oxazoline nucleus, thiozoline nucleus, pyrrole nucleus, oxazole nucleus, thiazole nucleus, selenazole nucleus, imidazole nucleus, tetrazole nucleus, pyridine nucleus; nuclei in which an alicyclic hydrocarbon ring is fused with these nuclei; and nuclei in which an aromatic hydrocarbon ring is fused with these nuclei, namely, for example, indolenine nucleus, benzoindolenine nucleus, indole nucleus, benzooxadole nucleus, naphthoxazole nucleus, benzothiazole nucleus, naphthothiazole nucleus, benzoselenazole nucleus, benzimidazole nucleus and quinoline nucleus. These nuclei may have a substituent on a carbon atom.

5- to 6-membered heterocyclic ring nuclei such as pyrazolin-5-on nucleus, thiohydantoin nucleus, 2-thiooxazolidin-2, 4-dione nucleus, thiazolidin-2,4-dione nucleus, rhodanine nucleus and thiobarbituric acid nucleus can be applied as nucleus having a ketomethylene structure, for a mellocyanine dye or a complex mellocyanine dye.

These sensitization dyes may be used alone, but its combination may be used and the combination of the sensitization dyes is often used for the purpose of supersensitization. Typical example thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707; BP Nos. 1,344,281 and 1,507,803; Jpn. Pat. Appln. KOKOKU Publication Nos. (hereinafter referred to as JP-B-)43-4936 and 53-12375; and JP-A-52-110618 and 52-109925.

A substance exhibiting supersensitization that is a dye having no spectral sensitization itself or a substance not substantially absorbing visible light may be contained in emulsion together with the sensitization dye. The timing of adding the sensitization dye in emulsion may be any stage of preparing the emulsion that has been hitherto known as effective. It is usually carried out at timing before coating after the completion of chemical sensitization, but it may be also added at the same stage with a chemical sensitization dye to simultaneously carry out the spectral sensitization and chemical sensitization as described in U.S. Pat. Nos. 3,628,969 and 4,225,666. Further, spectral sensitization may also be carried out in advance of the chemical sensitization as described in JP-A-58-113928, or alternatively, sensitization dye may be added before the completion of preparation of silver halide emulsion precipitate to start the spectral sensitization. Further, as disclosed in U.S. Pat. No. 4,225,666, these compounds can be also separately added, namely, a portion of these compounds is added in advance of the chemical sensitization and the residue can be also added after the chemical sensitization. It may be added at any timing during the formation of silver halide particles including methods disclosed in U.S. Pat. No. 4,183,756. As its addition amount, $4\times10^{-6}$ to $8\times10^{-3}$ mol per 1 mole of silver halide can be used.

With respect to the silver halide photosensitive material of the invention, it is necessary that the peak wavelength of spectral sensitivity of at least one green photosensitive layer is not more than ±10 nm, more preferably not more than ±7 nm, further preferably not more than ±5 nm and most preferably not more than ±1 nm in comparison with the peak wavelength of a green light source for exposure, but it is important how it is spectrally sensitized depending on the sensitization dye contained in the silver halide photosensitive material.

Specifically, it is necessary to mix a fixed amount of the sensitization dye for specific blue photosensitivity with the sensitization dye for green photosensitivity so that the peak wavelength of spectral sensitivity of at least one green photosensitive layer is not more than ±10 nm, not more than ±7 nm, not more than ±5 nm and not more than ±1 nm in comparison with the peak wavelength of a green light source for exposure. This is because, since the peak wavelength is 532 nm being slightly short wavelength when a green light source is solid laser, it is difficult to match the peak wavelength of solid laser with the peak wavelength of spectral sensitivity of the green photosensitive layer when only the sensitization dye for green photosensitivity is contained in the silver halide photosensitive material.

As the sensitization dye for green photosensitivity and the sensitization dye for blue photosensitivity, compounds ExS-8 and ExS-7 exemplified below are preferably used, but the invention should not be construed to be limited to these.

ExS-8

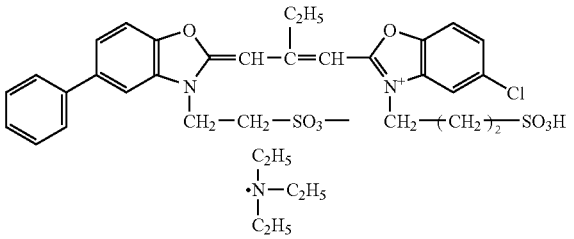

-continued

ExS-7

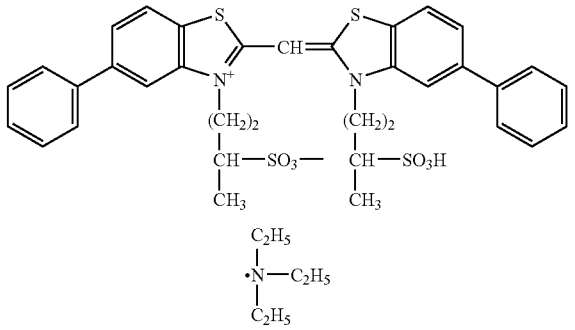

It is preferable that the molar ratio per 1 mole of Ag of the sensitization dye for green photosensitivity, for example, exemplified by the above-mentioned structural formula to the sensitization dye for blue photosensitivity is 1:1 at preparation of the particles of the silver halide photosensitive material of the invention so that when the green light source is solid laser, the peak wavelength of spectral sensitivity of at least one green photosensitive layer is not more than ±10 nm, not more than ±7 nm, or not more than ±5 nm in comparison with the peak wavelength of the solid laser. The reason why the molar ratio is preferably 1:1 is that there is a difference in adsorption energy between the sensitization dye for green photosensitivity and the sensitization dye for blue photosensitivity with respect to silver halide particles. When there is no difference in the adsorption energy, it is difficult to match the peak wavelength of the aforementioned solid laser with the peak wavelength of spectral sensitivity of at least one green photosensitive layer of the invention in case of the molar ratio of 1:1.

Further, also from the viewpoint of a molecular structure, the use of the sensitization dye for green photosensitivity exemplified by the aforementioned structure and the sensitization dye for blue photosensitivity is preferable for matching the peak wavelength of the aforementioned solid laser with the peak wavelength of spectral sensitivity of at least one green photosensitive layer of the invention. Namely, unless the size and shape of molecular structures are appropriate, the sensitization dye for green photosensitivity and the sensitization dye for blue photosensitivity adsorb separately on different spots of the silver halide particles because of steric hindrance on molecular structures. As a result, it is difficult to match the peak wavelength of the aforementioned solid laser with the peak wavelength of spectral sensitivity of at least one green photosensitive layer of the invention.

With respect to the silver halide photosensitive material of the invention, the peak wavelength of spectral sensitivity of at least one blue photosensitive layer is preferably not more than ±10 nm, more preferably not more than ±7 nm, further preferably not more than ±5 nm and most preferably not more than ±1 nm in comparison with the peak wavelength of a blue light source for exposure, but it is important how it is spectrally sensitized depending on the sensitization dye contained in the silver halide photosensitive material.

Specifically, as the sensitization dye for blue photosensitivity, compounds ExS-1 to ExS-3 exemplified below are preferably used so that the peak wavelength of spectral sensitivity of at least one blue photosensitive layer is not more than ±10 nm, not more than ±7 nm, not more than ±5 nm or not more than ±1 nm in comparison with the peak wavelength of a blue light source for exposure, but the invention should not be construed to be limited to these.

ExS-1

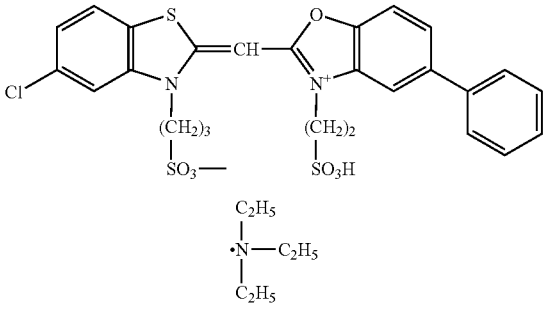

ExS-2

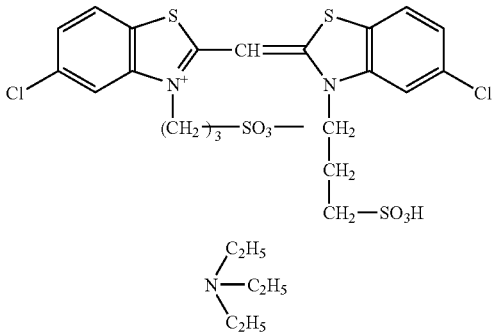

ExS-3

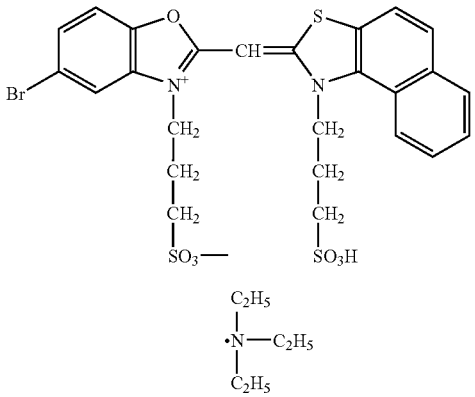

With respect to the silver halide photosensitive material of the invention, the peak wavelength of spectral sensitivity of at least one red photosensitive layer is preferably not more than ±10 nm, more preferably not more than ±7 nm, further preferably not more than ±5 nm and most preferably not more than ±1 nm in comparison with the peak wavelength of a red light source for exposure, but it is important how it is spectrally sensitized depending on the sensitization dye contained in the silver halide photosensitive material.

Specifically, as the sensitization dye for red photosensitivity, the compound ExS-11 exemplified below is preferably used so that the peak wavelength of spectral sensitivity of at least one red photosensitive layer is not more than ±10 nm, not more than ±7 nm, not more than ±5 nm or not more than ±1 nm in comparison with the peak wavelength of a red light source for exposure, but the invention should not be construed to be limited to these.

ExS-11

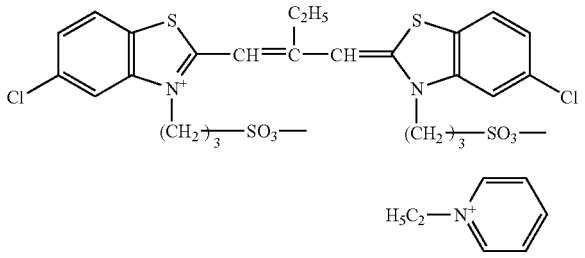

Then, the compound represented by the general formula (A) (the spectral sensitization dye (A)) and the compound represented by the general formula (B) (the spectral sensitization dye (B)) will be specifically described.

General formula (A)

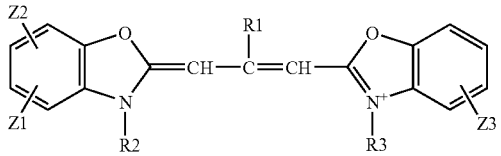

(X1)

General formula (B)

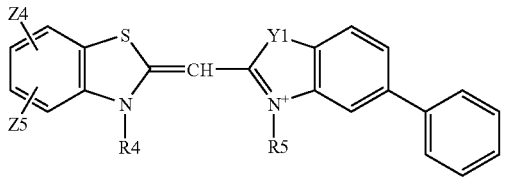

(X2)

In the general formula (A), R1 represents a hydrogen atom, an alkyl group (for example, methyl, ethyl or propyl) or an aryl group (for example, a phenyl group) and each of R2 and R3 represents an alkyl group (for example, methyl, ethyl, butyl, additionally, for example, sulfonethyl, carboxylpropyl and sulfobutyl having a substituent). Each of Z1 and Z2 represents a hydrogen atom, a halogen atom, a hydroxyl group, an alkoxy group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group. Z1 and Z2 may be the same substituent or may be different substituents. Z1 and Z2 may be mutually linked to form a ring. Z3 represents a halogen atom. X1 represents cationic counter ion for neutralizing electric charge if necessary.

In the general formula (B), Y1 represents sulfur or an oxygen atom and each of R4 and R5 represents an alkyl group (for example, methyl, ethyl, butyl, and additionally, for example, sulfonethyl, carboxylpropyl and sulfobutyl having a substituent). Each of Z4 and Z5 represents a hydrogen atom, a halogen atom, a hydroxyl group, an alkoxy group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group. Z4 and Z5 may be the same substituent or may be different substituents. Z4 and Z5 may be mutually linked to form a ring. X2 represents cationic counter ion for neutralizing electric charge if necessary.

The spectral sensitization dyes (A) and (B) of the invention have preferably an appropriate hydrophilic and hydrophobic difference. It is generally known that the higher the hydrophobic property is, the higher the adsorption energy on silver halide particles of the spectral sensitization dye is, and the lower the hydrophobic property is, the lower the adsorption energy is. Further, it is also known that the hydrophilic and hydrophobic properties of a general spectral sensitization dye can be controlled by the kind of a nuclear substitution group, the number of methine chains and the kind of N-positional substitution group.

When measuring the hydrophilic and hydrophobic properties of a compound, for example, Clog P is used. Usually, the hydrophilic and hydrophobic properties can be determined by the octanol/water partition coefficient (log P) of a compound. Specifically, it can be determined by measurement by a flask shaking method described in the under-mentioned literature (1).

<<Literature 1>>: edited by Toshio Fujita (Representative) of Structural Activity Correlation Advisory Organization, Chemical Region Special Number 122 "Structural Activity Correlation of Drug—Drug Design and Action Mechanism Research Guidance" Nanko-do, published in 1979, Second Edition pp. 43 to 203. In particular, the flask shaking method is described in pages 86 to 89 in the literature.

However, when the log P is 3 or more, measurement is occasionally difficult. Therefore, a model for calculating the log P is used to be specified. For example, Clog P can be calculated using, for example, the version of algorithm=4.01 and fragment data base=17 of the CLOGP program of Hansch-Leo (Daylight Chemical Information Systems Inc., USA). In this case P represents the partition coefficient of octanol/water of a compound and log P is its logarithm. Clog P is determined by the calculation of log P and is determined by the aforementioned CLOGP program in the present specification ("C" represents determination by "calculation").

When the above-mentioned calculation is carried out, the Clog P of the spectral sensitization dye (A) of the invention is preferably not more than −1.5, further preferably not more than −1.7 and most preferably not more than −1.9. Further, the Clog P of the spectral sensitization dye (B) of the invention is preferably not less than −1.0, further preferably not less than −0.9 and most preferably not less than −0.8.

Adsorption energy difference for silver halide surface can be generated by suitably controlling the difference in the hydrophilic and hydrophobic properties between the spectral sensitization dyes (A) and (B) of the invention. Further, the higher the adsorption energy is, the higher the efficiency of J-aggregate formation on silver halide particle surface is. Consequently, the spectral sensitization dye (B) of the invention having high adsorption energy forms stronger J-aggregates on the surface of silver halide particles than the spectral sensitization dye (A) of the invention. On the other hand, the spectral sensitization dye (A) of the invention is taken in the J-aggregates of the above-mentioned spectral sensitization dye (B) of the invention because of the difference in adsorption energy and can form the mix J-aggregates. Namely, the peak wavelength of spectral sensitivity can be controlled at an arbitrary peak wavelength by the difference in the hydrophilic and hydrophobic properties between the spectral sensitization dyes (A) and (B).

Further, the spectral sensitization dye (B) of the invention taken in shows a stronger adsorption property than a case of singly existing on the surface of silver halide particles because the spectral sensitization dye (A) of the invention plays a role of anchors. Consequently, since the swinging of the spectral sensitization dye in the silver halide photosensitive material can be remarkably improved, mix color caused by the migration of the spectral sensitization dye to other photosensitive layers can be remarkably suppressed.

Namely, as known by those skilled in the art, 2 or more spectral sensitization dyes are used in combination for obtaining spectral peak wavelength that cannot be obtained by only one spectral sensitization dye, but it is important to suitably select spectral sensitization dyes having different Clog P values in order to obtain a desired wavelength peak or from the viewpoint of mix color.

It is preferable that the above-mentioned compound ExS-8 as the spectral sensitization dye (A) of the invention and FxS-7 as the spectral sensitization dye (B) of the invention are used, but the invention should not be construed to be limited to this.

In general, when the adsorption energy of the spectral sensitization dye on the surface of silver halide particles is heightened, residual color is generated by the residual dye remaining in the silver halide photosensitive material after processing. Further, when the adsorption energy is lowered, mix color caused by swinging of the spectral sensitization dye into other photosensitive layers is generated.

Accordingly, it is important from the viewpoints of residual color and mix color that the use ratio of the spectral sensitization dyes having different hydrophilic and hydrophobic properties is suitably set.

Namely, in the invention, they are added so that the molar ratio of the spectral sensitization dyes (A) and (B) of the invention in the green photosensitive layer satisfies preferably the under-mentioned formula (II), more preferably the under-mentioned formula (II-2) and most preferably the under-mentioned formula (II-3), in order to record with little deterioration without mix color and residual color.

$$0.5 \leqq [A]/[B] \leqq 2.0 \quad \text{(II)}$$

$$0.6 \leqq [A]/[B] \leqq 1.6 \quad \text{(II-2)}$$

$$0.8 \leqq [A]/[B] \leqq 1.2 \quad \text{(II-3)}$$

where [A] and [B] respectively represent the molar number (mol/mol Ag) of the compound represented by the general formula (A) and the compound represented by the general formula (B) per 1 mole of silver halide in the green photosensitive layer.

Further, it is preferable that the granular mode of silver halide particles in emulsion in which the spectral sensitization dyes (A) and (B) of the invention are added is cubic in which a (100) plane is outer surface. In general, it is said that the spectral sensitization dye is thermodynamically more stabilized when the outer surface of silver halide particles is a (100) plane than a (111) plane. Viewing from the outer surface of silver halide particles, halogen ion sites on which the spectral sensitization dyes will adsorb are orderly arranged to a (110) direction on the (100) plane, but it is said that silver ion occupies 3/7 of lattice points of the uppermost layer on the (111) plane and it can be said that the spectral sensitization dyes hardly form aggregates comparatively.

Accordingly, it is preferable for recording without mix color that the granular mode of the silver halide particles is cubic in which the (100) plane is outer surface.

The digital image information of the invention will be described. The digital image information of the invention means, for example, image information obtained by digitizing image information photographed in a negative film for photographing by a film scanner, image information photographed by an HD video camera, and image information obtained by computer graphics and the like.

The pixel count of the invention will be described. The pixel count of the invention means the total number of pixels contained in the above-mentioned digital image information in the invention used at the time of recording on the silver halide photosensitive material. For example, when a negative film for photographing is digitized with a film scanner to prepare the image information of 2048×1556, the pixel count is 3.19 million pixels.

The method of evaluating blotting will be described.

In the invention, it is preferable that blotting k at the time of image recording satisfies the below-mentioned formula (I).

$$k \leqq 4.5 \times (D-0.2)^2 \quad \text{(I)}$$

In the formula (I);

D: Color density of the silver halide photosensitive material.

Blotting k: blotting (μm) at color density D.

Herein, it is necessary that the formula (I) is satisfied for all exposure light sources used at the time of image recording. For example, when exposure light sources use 3 color light sources of red, green and blue, the exposure of each single light is carried out and the color density D and the blotting k at that time satisfy the formula (I).

Further, although it is preferable that the formula (I) is satisfied for all zones from Dmin+0.2 to Dmax, an abridged evaluation method, in which evaluation is carried out in at least 2 points of the color densities of Dmin+1 and Dmin+2 and the formula (I) is satisfied at both the densities, may be used. Herein, Dmin represents the minimum value of the color density in a photosensitive material and corresponds to density after processing of an unexposed film. Dmax represents the maximum value of the color density in a photosensitive material. The maximum value of the color density corresponds to the maximum value of the density of digital image information. In the case of Cineon form widely used, the maximum density is an approximation of Dmin+2.

The blotting k is obtained by measuring the out-of-focus width of a color image at a density of Dmin+2 in a plane direction of the photosensitive material when exposure quantity is adjusted so that the photosensitive material develops color at the density of D and stepwise exposure is carried out as shown in the single FIGURE.

In the invention, it is preferable for recording with little deterioration that the blotting k at the time of image recording satisfies the above-mentioned formula (I), but it is more preferable to satisfy the below-mentioned formula (I-2) and it is most preferable to satisfy the below-mentioned formula (I-3).

$$k \leqq 4.0 \times (D-0.2)^2 \quad \text{(I-2)}$$

$$k \leqq 3.5 \times (D-0.2)^2 \quad \text{(I-3)}$$

Then, the method of evaluating color purity rate will be described.

In the invention, the color purity rate is represented by the below-mentioned formula (II) when symmetrical exposure is carried out by each single color of red, green and blue, and image density obtained for the main color density in the single color exposure is referred to as "a", and the color density of coloring different from the main color density existing in mixture in color at the density and color with high density is referred to as "b".

$$\text{Color purity rate (\%)}=(a-b)/a\times 100 \quad \text{(II)}$$

It is necessary that the color purity rate represented by the formula (B) is a specific value or more for all zones of the above-mentioned main color density from Dmin+0.1 to Dmax, and it is also necessary that the above condition is satisfied for all cases of the single color exposure of each of red, green and blue. Dmin represents the lowest value of the color density in a photosensitive material and corresponds to density after processing of an unexposed film. Dmax represents the maximum value of the color density in a photosensitive material. The maximum value of the color density corresponds to the maximum value of the density of digital image information. In the case of Cineon form widely used, the maximum density is an approximation of Dmin+2.

In the invention, it is preferable for recording with little deterioration that the color purity rate is 80% or more, but 85% or more is more preferable and 90% or more is further preferable.

Devices that can be used for the method of the invention and can record digital information on a silver halide photosensitive material are not particularly limited to film recorders, and therefore commercially available devices may also be used.

For example, commercially available devices include ARRILASER and ARRILASER HD manufactured by ARRI Group and using BGR laser as a light source system, FURY and FIRESTORM manufactured by CELCO Inc. and using a CRT system, IMAGICA realtime and an HSR high-speed recorder manufactured by IMAGICA Corporation and using an LCOS system, Cinevator One and Cinevator Five manufactured by CINEVATION AS, etc.

In the photosensitive material of the present invention, at least one blue-sensitive layer, at least one green-sensitive layer, and at least one red-sensitive layer can be formed on a support. A typical example is a silver halide photosensitive material having, on a support, at least one blue, green and red sensitive layer each consisting of a plurality of silver halide emulsion layers sensitive to substantially the same color but different in sensitivity, and at least one non-light-sensitive layer. This sensitive layer is a unit sensitive layer sensitive to one of blue light, green light, and red light. In a multilayered silver halide color photographic light-sensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, layers can be arranged such that a low-speed emulsion layer is formed apart from a support and a high-speed layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, layers can be arranged in the order of a blue-sensitive layer/GH/RH/GL/RL from the one farthest from a support. Furthermore, as described in JP-A's-56-25738 and 62-63936, layers can be arranged in the order of a blue-sensitive layer/GL/RL/GH/RH from the one farthest from a support.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When the layer structure is thus constituted by three layers having different sensitivities, these three layers can be arranged, in the same color-sensitive layer, in the order of a medium-speed emulsion layer/high-speed emulsion layer/low-speed emulsion layer from the one farthest from a support as described in JP-A-59-202464.

In addition, the order of a high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

A silver halide used in the present invention is silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof. In the present invention, cubic emulsion is preferred.

The silver halide may have a particle diameter of as fine as about 0.2 μm or less, may be a large-sized particle in which the diameter of a projection area is up to about 10 μm, and may be polydisperse emulsion or monodisperse emulsion. In the invention, however, the use of fine particles with a particle diameter of 0.2 μm or less is preferable for improving image quality.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., U.S. Pat. Nos. 3,574,628, 3,655,394, and GB1,413,748, the disclosures of which are incorporated herein by reference, are also favorable.

Tabular grains having an aspect ratio of about 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, 4,439,520, and GB2,112,157, the disclosures of which are incorporated herein by reference.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

It is preferable that the above emulsion has dislocation lines. In the tabular grains, it is especially preferred that dislocation lines are viewed in the fringe portion thereof. Dislocation lines can be introduced by, for example, adding an aqueous solution such as an alkali iodide aqueous solution to form a high silver iodide layer, adding AgI fine grains, or a method as described in JP-A-5-323487.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

As the silver halide emulsion, those to which physical ripening, chemical ripening and spectral sensitization are carried out are usually used. Additives used in the step are described in RD Nos. 17643, 18716 and 307105 and the corresponding spots were summarized in the Table below.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 0.2 μm.

The fine-grain silver halide can be prepared following the same procedures as for a common light-sensitive silver halide. The surface of each silver halide grain may be either spectrally sensitized/chemically sensitized or not spectrally sensitized/chemically sensitized. Further, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

From the viewpoint of improvement of the sharpness, the silver coating amount of a photosensitive material of the present invention is preferably 1.0 to 8.0 g/m$^2$, more preferably 1.0 to 5.0 g/m$^2$, and most preferably 1.0 to 3.0 g/m$^2$.

Photographic additives usable in the present invention are also described in RDs, and the relevant portions are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23-24 | page 648, right column to page 649, right column | pages 866-868 |
| 4. Brighteners | page 24 | page 647, right column | page 868 |
| 5. Light absorbents, filter dyes, ultraviolet absorbents | pages 25-26 | page 649, right column to page 650, left column | page 873 |
| 6. Binders | page 26 | page 651, left column | pages 873-874 |
| 7. Plasticizers, lubricants | page 27 | page 650, right column | page 876 |
| 8. Coating aids, surface active agents | pages 26-27 | page 650, right column | pages 875-876 |
| 9. Antistatic agents | page 27 | page 650, right column | pages 876-877 |
| 10. Matting agents | | | pages 878-879 |

Various dye forming couplers can be used in a light-sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, the disclosures of which are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, the disclosures of which are incorporated herein by reference.

Polymer couplers: P-1 and P-5 (page 11) in JP-A-2-44345, the disclosure of which is incorporated herein by reference.

Couplers for forming a colored dye with proper diffusibility are preferably those described in U.S. Pat. No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, the disclosures of which are incorporated herein by reference.

Examples of compounds (including a coupler) which react with a developing agent in an oxidized form to thereby release a photographically useful compound residue are as follows.

Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2;

bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411;

ligand release compounds: compounds (particularly compounds in column 12, lines 21 to 41) represented by LIG-X described in claim 1 of U.S. Pat. No. 4,555,478;

leuco dye release compounds: compounds 1 to 6 in columns 3 to 8 of U.S. Pat. No. 4,749,641;

fluorescent dye release compounds: compounds (particularly compounds 1 to 11 in columns 7 to 10) represented by COUP-DYE in claim 1 of U.S. Pat. No. 4,774,181;

development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2;

compounds which release a group which does not function as a dye unless it splits off: compounds (particularly Y-1 to Y-19 in columns 25 to 36) represented by formula (I) in claim 1 of U.S. Pat. No. 4,857,447, the disclosures of which are incorporated herein by reference.

Preferred examples of additives other than couplers are as follows.

Dispersants of oil-soluble organic compounds: P-3, P-5, P-16, P-19, P-25, P-30, P-42, P-49, P-54, P-55, P-66, P-81, P-85, P-86, and P-93 (pages 140 to 144) in JP-A-62-215272;

impregnating latexes of oil-soluble organic compounds: latexes described in U.S. Pat. No. 4,199,363;

developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787;

blotting inhibitors: formulas (I) to (III) on page 4, lines 30 to 33, particularly I-47, I-72, III-1, and III-27 (pages 24 to 48) in EP298321A;

discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931;

materials which reduce the use amount of a color enhancer or a color amalgamation inhibitor: I-1 to II-15, particularly I-46 on pages 5 to 24 of EP411324A;

formalin scavengers: SCV-1 to SCV-28, particularly SCV-8 on pages 24 to 29 of EP477932A;

film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287;

development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790;

stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483;

chemical sensitizers: triphenylphosphine selenide and a compound 50 in JP-A-5-40324;

dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine-crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788;

UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A, the disclosures of which are incorporated herein by reference.

Supports which can be suitably used in the present invention are described in, e.g., RD. No. 17643, page 28; RD. No. 18716, from the right column of page 647 to the left column of page 648; and RD. No. 307105, page 879.

In the photosensitive material of the present invention, the thickness of photosensitive silver halide layer closest to the support through surface of the photosensitive material is preferably 24 μm or less, more preferably 22 μm or less, and most preferably 20 μm or less. Film swelling speed $T_{1/2}$ is preferably 30 sec or less, more preferably 20 sec or less. The film swelling speed $T_{1/2}$ is defined as the time that when the saturation film thickness refers to 90% of the maximum swollen film thickness attained by the processing in a color developer at 30° C. for 3 min 15 sec, is spent for the film thickness to reach ½ of the saturation film thickness. The film thickness means one measured under moisture conditioning at 25° C. in a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardener to gelatin as a binder, or by changing aging conditions after coating. The swelling ratio preferably ranges from 150 to 400%. The swelling ratio can be calculated from the maximum swollen film thickness measured under the above conditions in accordance with the formula:

(maximum swollen film thickness−film thickness)/film thickness.

In the photosensitive material of the present invention, hydrophilic colloid layers (referred to as "back layers") having a total dry film thickness of 2 to 20 μm are preferably provided on the side opposite to the side having emulsion layers. These back layers preferably contain the aforementioned light absorbent, filter dye, ultraviolet absorbent, antistatic agent, film hardener, binder, plasticizer, lubricant, coating aid and surfactant. The swelling ratio of these back layers is preferably in the range of 150 to 500%.

A polyester support used in the present invention will be described below. Details of the polyester support and light-sensitive materials, processing, cartridges, and examples (to be described later) are described in Journal of Technical Disclosure No. 94-6023 (JIII; 1994, Mar. 15), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg −20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro- 6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/$m^2$, and particularly preferably, 10 to 350 mg/$m^2$. The ratio of a conductive crystalline oxide or its composite oxide to the binder is preferably 1/300 to 100/1, and more preferably, 1/100 to 100/5.

A photosensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A photosensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

The invention will be described below according to Examples in detail, but the invention is not limited to these Examples.

EXAMPLE 1

Preparation of Emulsions Em-A, and Em-(1), (2) and (3))

AgBrI monodisperse cubic emulsion was prepared in accordance with the following. The below-mentioned solution was prepared.

<<Solution A>> Aqueous solution containing 30 g of limed ossein gelatin, 0.4 g of KBr and 1.3 L of water.

<<Solution B>> 0.2 L of aqueous solution containing 20 g of $AgNO_3$.

<<Solution C>> 0.2 L of aqueous solution containing 15 g of KBr and 0.6 g of KI.

<<Solution D>> 0.65 L of aqueous solution containing 162.5 g of $AgNO_3$.

<<Solution E>> 0.7 L of aqueous solution containing 124.8 g of KBr, 5.4 g of KI and 0.6 g of NaCl.

The solution A was charged in a reaction vessel and kept warm at 60° C. to be stirred. 150 mL of the solution B was added over 5 minutes. The solution C was added while controlling its addition amount during this time so that pBr in the reaction vessel was kept at 3.5. After completion of the addition, the temperature of the solution in the reaction vessel was raised to 70° C. Successively, 540 mL of the solution D was added over 15 minutes. During this time, the solution E was added while controlling its addition amount so that pBr in the reaction vessel was kept at 3.5. Further, 0.005 g of thiourea dioxide, 0.005 g of sodium benzenesulfonate and 0.0003 g of $K_2IrCl_6$ were added in the reaction vessel during the addition.

After completion of the addition, a desalting process was carried out by a flocculation process. After completion of the desalting process, the below-mentioned chemical sensitization processing and spectral sensitization processing were carried out. The emulsion after completion of the desalting was kept warm at 60° C., sensitization dyes, potassium thiocyanate, chloroauric acid, sodium thiosulfate, N,N-dimethyl selenourea, 4-hydroxy-6-methyl-1,3,3a, 7-tetraazaindene (TAI), the compounds 1, 2 and 3 were added thereto and spectral sensitization and chemical sensitization were carried out optimally. With respect to the sensitization dyes, an optimum amount of the dyes shown in Table 1 was added while suitably changing their ratios. The grains contained in each of the emulsions Em-A, and (1)-(3) obtained were cubic grains with an average equivalent-spherical diameter of 0.18 μm and a variation coefficient of 11%.

(Preparation of Emulsions Em-B, D, G, (4), (5), (6), (10), (11), (12), (13), (14), (15), (16), (17), (18), (19) and (40)

Emulsions Em-B, D, G, (4)-(6), (10)-(19) and (40) were prepared in the same manner as the above-mentioned emulsions Em-A, and (1)-(3) except that the temperature of solutions in the reaction vessel, the compositions and densities of the solutions A to E, the addition speed of the solutions B to E, pBr of the solutions in the reaction vessel, the addition amounts of thiourea dioxide, sodium benzenesulfonate and $K_2IrCl_6$, sensitization dyes after completion of desalting and chemical sensitization were suitably changed in the preparation of the above-mentioned emulsions Em-A, and (1)-(3).

(Preparation of Emulsions Em-C, (7), (8) and (9))

AgBr I monodisperse cubic emulsion was prepared in accordance with the following. The below-mentioned solution was prepared.

<<Solution A>> Aqueous solution containing 30 g of limed ossein gelatin, 0.4 g of KBr and 1.5 L of water.

<<Solution B>> 0.65 L of aqueous solution containing 162.5 g of $AgNO_3$.

<<Solution C>> 0.7 L of aqueous solution containing 125.4 g of KBr, 4.5 g of KI and 0.3 g of NaCl.

The solution A was charged in a reaction vessel and kept warm at 55° C. to be stirred. 540 mL of the solution B was added over 10 minutes. The solution C was added while controlling its addition amount during this time so that pBr in the reaction vessel was kept at 3.5. Further, 0.007 g of thiourea dioxide, 0.007 g of sodium benzenesulfonate and 0.0005 g of $K_2IrCl_6$ were added in the reaction vessel during the addition.

After completion of the addition, a desalting process was carried out by a flocculation process. After completion of the desalting process, the below-mentioned chemical sensitization processing and spectral sensitization processing were carried out. The emulsion after completion of the desalting was kept warm at 62° C., sensitization dyes, chloroauric acid, sodium thiosulfate, 4-hydroxy-6-methyl-1,3,3a, 7-tetraazaindene (TAI), the compounds 1, 2 and 3 were added thereto and spectral sensitization and chemical sensitization were carried out optimally. With respect to the sensitization dyes, an optimum amount of the dyes shown in Table 1 was added while suitably changing their ratios. The grains contained in each of emulsions Em-C, and (7)-(9) obtained were cubic grains with an average equivalent-spherical diameter of 0.10 μm and a variation coefficient of 13%.

(Preparation of Emulsions Em-E, F, H, I, (20)-(39), and (42)-(45))

Emulsions Em-E, F, H, I, (20)-(39), and (42)-(45) were prepared in the same manner as the above-mentioned emulsions Em-C and (7)-(9) except that the temperature of solutions in the reaction vessel, the compositions and densities of the solutions A to C, the addition speed of the solutions B and C, pBr of the solutions in the reaction vessel, the addition amounts of thiourea dioxide, sodium benzenesulfonate and $K_2IrCl_6$, sensitization dyes after completion of desalting and chemical sensitization were suitably changed in the preparation of the above-mentioned emulsion Em-C and (7)-(9).

(Preparation of Emulsions Em-5, 6 and 7)

Emulsions Em-5, 6 and 7 were prepared in the same manner as the above-mentioned emulsion Em-D except that the sensitization dyes were suitably changed in the preparation of the above-mentioned emulsion Em-D.

(Preparation of Emulsions Em-12, 13 and 14)

Emulsions Em-12, 13 and 14 were prepared in the same manner as the above-mentioned emulsion Em-E except that the sensitization dyes were suitably changed in the preparation of the above-mentioned emulsion Em-E.

(Preparation of Emulsions Em-19, 20 and 21)

Emulsions Em-19, 20 and 21 were prepared in the same manner as the above-mentioned emulsion Em-F except that the sensitization dyes were suitably changed in the preparation of the above-mentioned emulsion Em-F.

(Preparation of Emulsions Em-1, 2, 3 and 4)

AgBr I monodisperse octahedral emulsions were prepared in accordance with the following.

Emulsions Em-1, 2, 3 and 4 were prepared in the same manner as the above-mentioned emulsion Em-D except that pBr of the solutions in the reaction vessel was changed to 2.7 and sensitization dyes were suitably changed in the preparation of the above-mentioned emulsion Em-D.

(Preparation of Emulsions Em-8, 9, 10 and 11)

AgBr I monodisperse octahedral emulsions were prepared in accordance with the following.

Emulsions Em-8, 9, 10 and 11 were prepared in the same manner as the above-mentioned emulsion Em-E except that pBr of the solutions in the reaction vessel was changed to 2.7 and sensitization dyes were suitably changed in the preparation of the above-mentioned emulsion Em-E.

(Preparation of Emulsions Em-15, 16, 17 and 18)

AgBr I monodisperse octahedral emulsions were prepared in accordance with the following.

Emulsions Em-15, 16, 17 and 18 were prepared in the same manner as the above-mentioned emulsion Em-F except that pBr of the solutions in the reaction vessel was changed to 2.7 and sensitization dyes were suitably changed in the preparation of the above-mentioned emulsion Em-F.

TABLE 1

| Emulsion | Grain shape | Av. grain size*1 (μm) | COV (%) of ESD*2 | I content (mol %) | Cl content (mol %) | Sensitizing dye*3 |
|---|---|---|---|---|---|---|
| Em-A | Cube | 0.18 | 11 | 3.1 | 1 | ExS-6[$1.0 \times 10^{-3}$] |
| Em-B | Cube | 0.14 | 12 | 3.0 | 0 | ExS-6[$1.5 \times 10^{-3}$] |
| Em-C | Cube | 0.10 | 13 | 2.5 | 0.5 | ExS-6[$2.0 \times 10^{-3}$] |
| Em-D | Cube | 0.11 | 12 | 3.3 | 0.5 | ExS-14[$1.0 \times 10^{-3}$] |
| Em-E | Cube | 0.09 | 12 | 2.8 | 0 | ExS-14[$1.2 \times 10^{-3}$] |
| Em-F | Cube | 0.08 | 14 | 2.2 | 0 | ExS-14[$8.8 \times 10^{-4}$] |
| Em-G | Cube | 0.10 | 13 | 2.8 | 1 | ExS-13[$7.25 \times 10^{-4}$]/ExS-11[$7.25 \times 10^{-4}$] |
| Em-H | Cube | 0.08 | 14 | 2.2 | 0 | ExS-13[$1.09 \times 10^{-3}$]/ExS-11[$1.09 \times 10^{-3}$] |
| Em-I | Cube | 0.07 | 14 | 2.2 | 0 | ExS-13[$4.8 \times 10^{-4}$]/ExS-11[$4.8 \times 10^{-4}$] |
| Em-(1) | Cube | 0.18 | 11 | 3.1 | 1 | ExS-2[$6.0 \times 10^{-4}$]/ExS-3[$4.0 \times 10^{-4}$] |
| Em-(2) | Cube | 0.18 | 11 | 3.1 | 1 | ExS-1[$1.0 \times 10^{-4}$]/ExS-2[$5.0 \times 10^{-4}$]/ExS-3[$4.0 \times 10^{-4}$] |
| Em-(3) | Cube | 0.18 | 11 | 3.1 | 1 | ExS-1[$5.0 \times 10^{-4}$]/ExS-2[$1.0 \times 10^{-4}$]/ExS-3[$4.0 \times 10^{-4}$] |
| Em-(4) | Cube | 0.14 | 12 | 3.0 | 0 | ExS-2[$9.0 \times 10^{-4}$]/ExS-3[$6.0 \times 10^{-4}$] |
| Em-(5) | Cube | 0.14 | 12 | 3.0 | 0 | ExS-1[$1.5 \times 10^{-4}$]/ExS-2[$7.5 \times 10^{-4}$]/ExS-3[$6.0 \times 10^{-4}$] |
| Em-(6) | Cube | 0.14 | 12 | 3.0 | 0 | ExS-1[$7.5 \times 10^{-4}$]/ExS-2[$1.5 \times 10^{-4}$]/ExS-3[$6.0 \times 10^{-4}$] |
| Em-(7) | Cube | 0.10 | 13 | 2.5 | 0.5 | ExS-2[$1.2 \times 10^{-3}$]/ExS-3[$8.0 \times 10^{-4}$] |
| Em-(8) | Cube | 0.10 | 13 | 2.5 | 0.5 | ExS-1[$2.0 \times 10^{-4}$]/ExS-2[$1.0 \times 10^{-3}$]/ExS-3[$8.0 \times 10^{-4}$] |
| Em-(9) | Cube | 0.10 | 13 | 2.5 | 0.5 | ExS-1[$1.0 \times 10^{-3}$]/ExS-2[$2.0 \times 10^{-4}$]/ExS-3[$8.0 \times 10^{-4}$] |
| Em-(10) | Cube | 0.11 | 12 | 3.3 | 0.5 | ExS-4[$1.0 \times 10^{-3}$] |
| Em-(11) | Cube | 0.11 | 12 | 3.3 | 0.5 | ExS-7[$3.0 \times 10^{-4}$]/ExS-8[$7.0 \times 10^{-4}$] |
| Em-(12) | Cube | 0.11 | 12 | 3.3 | 0.5 | ExS-7[$3.5 \times 10^{-4}$]/ExS-8[$6.5 \times 10^{-4}$] |
| Em-(13) | Cube | 0.11 | 12 | 3.3 | 0.5 | ExS-7[$4.0 \times 10^{-4}$]/ExS-8[$6.0 \times 10^{-4}$] |
| Em-(14) | Cube | 0.11 | 12 | 3.3 | 0.5 | ExS-7[$5.0 \times 10^{-4}$]/ExS-8[$5.0 \times 10^{-4}$] |

TABLE 1-continued

| Emulsion | Grain shape | Av. grain size*1 (μm) | COV (%) of ESD*2 | I content (mol %) | Cl content (mol %) | Sensitizing dye*3 |
|---|---|---|---|---|---|---|
| Em-(15) | Cube | 0.11 | 12 | 3.3 | 0.5 | ExS-7[$6.0 \times 10^{-4}$]/ExS-8[$4.0 \times 10^{-4}$] |
| Em-(16) | Cube | 0.11 | 12 | 3.3 | 0.5 | ExS-7[$6.5 \times 10^{-4}$]/ExS-8[$3.5 \times 10^{-4}$] |
| Em-(17) | Cube | 0.11 | 12 | 3.3 | 0.5 | ExS-7[$7.0 \times 10^{-4}$]/ExS-8[$3.0 \times 10^{-4}$] |
| Em-(18) | Cube | 0.11 | 12 | 3.3 | 0.5 | ExS-7[$9.0 \times 10^{-4}$]/ExS-8[$1.0 \times 10^{-4}$] |
| Em-(19) | Cube | 0.11 | 12 | 3.3 | 0.5 | ExS-9[$5.0 \times 10^{-4}$]/ExS-10[$5.0 \times 10^{-4}$] |
| Em-(20) | Cube | 0.09 | 12 | 2.8 | 0 | ExS-4[$1.2 \times 10^{-3}$] |
| Em-(21) | Cube | 0.09 | 12 | 2.8 | 0 | ExS-7[$3.6 \times 10^{-4}$]/ExS-8[$8.4 \times 10^{-4}$] |
| Em-(22) | Cube | 0.09 | 12 | 2.8 | 0 | ExS-7[$4.2 \times 10^{-4}$]/ExS-8[$7.8 \times 10^{-4}$] |
| Em-(23) | Cube | 0.09 | 12 | 2.8 | 0 | ExS-7[$4.8 \times 10^{-4}$]/ExS-8[$7.2 \times 10^{-4}$] |
| Em-(24) | Cube | 0.09 | 12 | 2.8 | 0 | ExS-7[$6.0 \times 10^{-4}$]/ExS-8[$6.0 \times 10^{-4}$] |
| Em-(25) | Cube | 0.09 | 12 | 2.8 | 0 | ExS-7[$8.4 \times 10^{-4}$]/ExS-8[$3.6 \times 10^{-4}$] |
| Em-(26) | Cube | 0.09 | 12 | 2.8 | 0 | ExS-7[$7.8 \times 10^{-4}$]/ExS-8[$4.2 \times 10^{-4}$] |
| Em-(27) | Cube | 0.09 | 12 | 2.8 | 0 | ExS-7[$7.2 \times 10^{-4}$]/ExS-8[$4.8 \times 10^{-4}$] |
| Em-(28) | Cube | 0.09 | 12 | 2.8 | 0 | ExS-7[$1.0 \times 10^{-3}$]/ExS-8[$2.0 \times 10^{-4}$] |
| Em-(29) | Cube | 0.09 | 12 | 2.8 | 0 | ExS-9[$6.0 \times 10^{-4}$]/ExS-10[$6.0 \times 10^{-4}$] |
| Em-(30) | Cube | 0.08 | 14 | 2.2 | 0 | ExS-4[$8.8 \times 10^{-4}$] |
| Em-(31) | Cube | 0.08 | 14 | 2.2 | 0 | ExS-7[$2.6 \times 10^{-4}$]/ExS-8[$6.2 \times 10^{-4}$] |
| Em-(32) | Cube | 0.08 | 14 | 2.2 | 0 | ExS-7[$3.1 \times 10^{-4}$]/ExS-8[$5.7 \times 10^{-4}$] |
| Em-(33) | Cube | 0.08 | 14 | 2.2 | 0 | ExS-7[$3.5 \times 10^{-4}$]/ExS-8[$5.3 \times 10^{-4}$] |
| Em-(34) | Cube | 0.08 | 14 | 2.2 | 0 | ExS-7[$4.4 \times 10^{-4}$]/ExS-8[$4.4 \times 10^{-4}$] |
| Em-(35) | Cube | 0.08 | 14 | 2.2 | 0 | ExS-7[$5.3 \times 10^{-4}$]/ExS-8[$3.5 \times 10^{-4}$] |
| Em-(36) | Cube | 0.08 | 14 | 2.2 | 0 | ExS-7[$5.7 \times 10^{-4}$]/ExS-8[$3.1 \times 10^{-4}$] |
| Em-(37) | Cube | 0.08 | 14 | 2.2 | 0 | ExS-7[$6.2 \times 10^{-4}$]/ExS-8[$2.6 \times 10^{-4}$] |
| Em-(38) | Cube | 0.08 | 14 | 2.2 | 0 | ExS-7[$7.0 \times 10^{-4}$]/ExS-8[$1.8 \times 10^{-4}$] |
| Em-(39) | Cube | 0.08 | 14 | 2.2 | 0 | ExS-9[$4.4 \times 10^{-4}$]/ExS-10[$4.4 \times 10^{-4}$] |
| Em-(40) | Cube | 0.10 | 13 | 2.8 | 1 | ExS-12[$1.5 \times 10^{-3}$] |
| Em-(41) | Cube | 0.10 | 13 | 2.8 | 1 | ExS-11[$1.3 \times 10^{-3}$]/ExS-12[$1.5 \times 10^{-4}$] |
| Em-(42) | Cube | 0.08 | 14 | 2.2 | 0 | ExS-12[$2.2 \times 10^{-3}$] |
| Em-(43) | Cube | 0.08 | 14 | 2.2 | 0 | ExS-11[$1.95 \times 10^{-3}$]/ExS-12[$2.3 \times 10^{-4}$] |
| Em-(44) | Cube | 0.07 | 14 | 2.2 | 0 | ExS-12[$9.5 \times 10^{-4}$] |
| Em-(45) | Cube | 0.07 | 14 | 2.2 | 0 | ExS-11[$8.6 \times 10^{-4}$]/ExS-12[$9.0 \times 10^{-5}$] |

*1Av. grain size is an average equivalent-spherical diameter.
*2COV: coefficient of variation; ESD: equivalent-spherical diameter
*3[ ] indicates an addition amount (mol/mol Ag).

TABLE 2

| Emulsion | Grain shape | Av. grain size*1 (μm) | COV (%) of ESD*2 | I content (mol %) | Cl content (mol %) | Sensitizing dye*3 |
|---|---|---|---|---|---|---|
| Em-1 | Octahedron | 0.11 | 12 | 3.3 | 0 | ExS-8[$1.0 \times 10^{-3}$] |
| Em-2 | Octahedron | 0.11 | 12 | 3.3 | 0 | ExS-8[$5.0 \times 10^{-4}$]/ExS-6[$5.0 \times 10^{-4}$] |
| Em-3 | Octahedron | 0.11 | 12 | 3.3 | 0 | ExS-7[$5.0 \times 10^{-4}$]/ExS-4[$5.0 \times 10^{-4}$] |
| Em-4 | Octahedron | 0.11 | 12 | 3.3 | 0 | ExS-8[$5.0 \times 10^{-4}$]/ExS-7[$5.0 \times 10^{-4}$] |
| Em-5 | Cube | 0.11 | 12 | 3.3 | 0 | ExS-8[$1.0 \times 10^{-3}$] |
| Em-6 | Cube | 0.11 | 12 | 3.3 | 0 | ExS-8[$5.0 \times 10^{-4}$]/ExS-6[$5.0 \times 10^{-4}$] |
| Em-7 | Cube | 0.11 | 12 | 3.3 | 0 | ExS-7[$5.0 \times 10^{-4}$]/ExS-4[$5.0 \times 10^{-4}$] |
| Em-8 | Octahedron | 0.09 | 12 | 2.8 | 0 | ExS-8[$1.2 \times 10^{-3}$] |
| Em-9 | Octahedron | 0.09 | 12 | 2.8 | 0 | ExS-8[$6.0 \times 10^{-4}$]/ExS-6[$6.0 \times 10^{-4}$] |
| Em-10 | Octahedron | 0.09 | 12 | 2.8 | 0 | ExS-7[$6.0 \times 10^{-4}$]/ExS-4[$6.0 \times 10^{-4}$] |
| Em-11 | Octahedron | 0.09 | 12 | 2.8 | 0 | ExS-8[$6.0 \times 10^{-4}$]/ExS-7[$6.0 \times 10^{-4}$] |
| Em-12 | Cube | 0.09 | 12 | 2.8 | 0 | ExS-8[$1.2 \times 10^{-3}$] |
| Em-13 | Cube | 0.09 | 12 | 2.8 | 0 | ExS-8[$6.0 \times 10^{-4}$]/ExS-6[$6.0 \times 10^{-4}$] |
| Em-14 | Cube | 0.09 | 12 | 2.8 | 0 | ExS-7[$6.0 \times 10^{-4}$]/ExS-4[$6.0 \times 10^{-4}$] |
| Em-15 | Octahedron | 0.08 | 14 | 2.2 | 0 | ExS-8[$8.8 \times 10^{-4}$] |
| Em-16 | Octahedron | 0.08 | 14 | 2.2 | 0 | ExS-8[$4.4 \times 10^{-4}$]/ExS-6[$4.4 \times 10^{-4}$] |
| Em-17 | Octahedron | 0.08 | 14 | 2.2 | 0 | ExS-7[$4.4 \times 10^{-4}$]/ExS-4[$4.4 \times 10^{-4}$] |
| Em-18 | Octahedron | 0.08 | 14 | 2.2 | 0 | ExS-8[$4.4 \times 10^{-4}$]/ExS-7[$4.4 \times 10^{-4}$] |
| Em-19 | Cube | 0.08 | 14 | 2.2 | 0 | ExS-8[$8.8 \times 10^{-4}$] |
| Em-20 | Cube | 0.08 | 14 | 2.2 | 0 | ExS-8[$4.4 \times 10^{-4}$]/ExS-6[$4.4 \times 10^{-4}$] |
| Em-21 | Cube | 0.08 | 14 | 2.2 | 0 | ExS-7[$4.4 \times 10^{-4}$]/ExS-4[$4.4 \times 10^{-4}$] |

*1Av. grain size is an average equivalent-spherical diameter.
*2COV: coefficient of variation; ESD: equivalent-spherical diameter
*3[ ] indicates an addition amount (mol/mol Ag).

TABLE 2-continued
| Emul-sion | Grain shape | Av. grain size*1 (μm) | COV (%) of ESD*2 | I content (mol %) | Cl content (mol %) | Sensitizing dye*3 |
|---|---|---|---|---|---|---|
| | | | | | | ExS-4 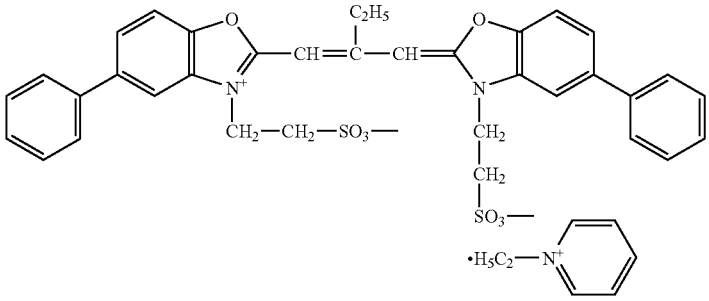 |
| | | | | | | ExS-6 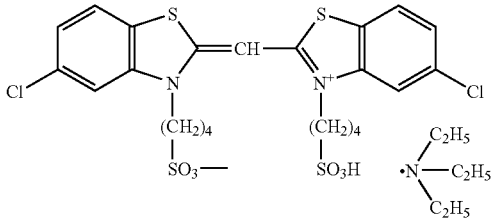 |
| | | | | | | ExS-9 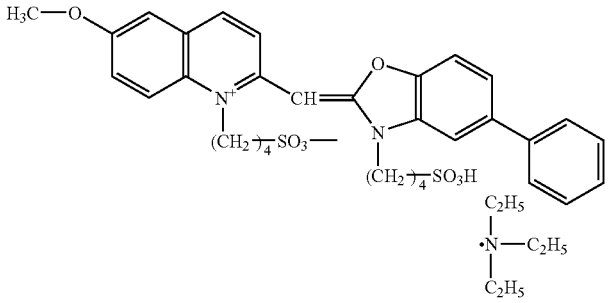 |
| | | | | | | ExS-10 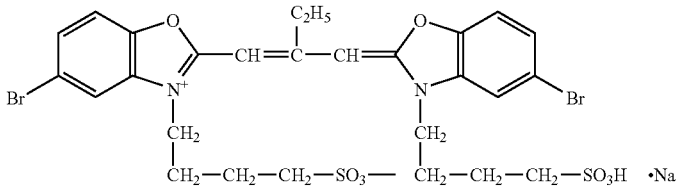 |
| | | | | | | ExS-13 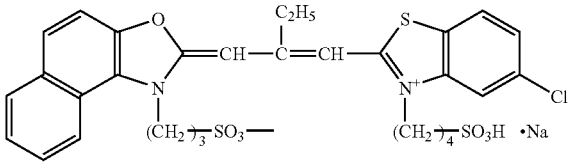 |
| | | | | | | ExS-12 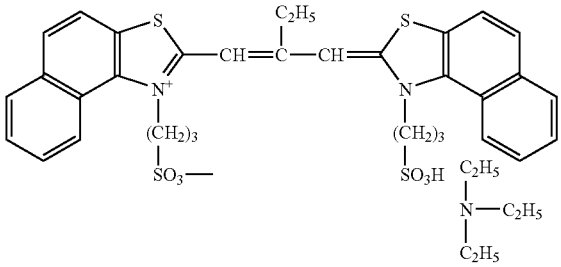 |

TABLE 2-continued

| Emul-sion | Grain shape | Av. grain size*1 (μm) | COV (%) of ESD*2 | I content (mol %) | Cl content (mol %) | Sensitizing dye*3 |
|---|---|---|---|---|---|---|
| | | | | | | ExS-14 |

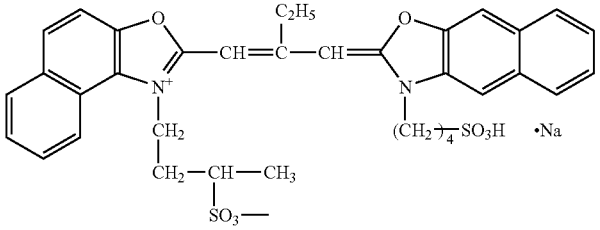

(Preparation of a Multilayer Color Photosensitive Material (Sample 101))

One surface of the undercoated cellulose triacetate film support was coated with a back layer having the following composition.

| (Back layer) | |
|---|---|
| Methylmethacrylate-methacrylic acid copolymer (copolymerization molar ratio 1:1) | 1.5 parts by mass |
| Cellulose acetate hexahydrophthalate (4% hydroxypropyl group, 15% methyl group, 8% acetyl group, and 36% phthalyl group) | 1.5 parts by mass |
| Acetone | 50 parts by mass |
| Methanol | 25 parts by mass |
| Methylcellosolve | 25 parts by mass |
| Colloid carbon | 1.2 parts by mass |

Coating solution was prepared at a proportion below and coated so that density was 1.0 for white light.

Undercoating was carried out at a side opposite to a back layer of a support on which the back layer was coated, and a sample 101 which is the multilayer color photosensitive material including respective layers with compositions shown in the following was prepared.

(Composition of Photosensitive Material)

Coating amounts were shown by the amount of Ag represented by a unit of g/m$^2$ for silver halide and colloidal silver and amounts represented by a unit of g/m$^2$ for a coupler, an additive and gelatin.

| | | |
|---|---|---|
| **1st layer (antihalation layer)** | | |
| Black colloidal silver | silver coating amt. | 0.090 |
| Silver iodobromide emulsion grain (average grain diameter 0.07 μm, silver iodide content 2 mol %) | silver coating amt. | 0.020 |
| Gelatin | | 0.910 |
| **2nd layer (Interlayer)** | | |
| Gelatin | | 2.160 |
| ExF-4 | | 0.694 |
| **3rd layer (Low-speed red-sensitive emulsion layer)** | | |
| Em-I | silver coating amt. | 0.265 |
| Gelatin | | 1.900 |
| ExC-1 | | 0.141 |
| ExC-2 | | 0.194 |
| ExC-3 | | 0.019 |
| ExC-4 | | 0.034 |
| ExC-5 | | 0.029 |

-continued

| | | |
|---|---|---|
| Cpd-2 | | 0.105 |
| Solv-1 | | 0.440 |
| **4th layer (Medium-speed red-sensitive emulsion layer)** | | |
| Em-H | silver coating amt. | 0.236 |
| Gelatin | | 1.067 |
| ExC-1 | | 0.091 |
| ExC-2 | | 0.125 |
| ExC-3 | | 0.015 |
| ExC-4 | | 0.028 |
| ExC-5 | | 0.008 |
| Cpd-2 | | 0.069 |
| Solv-1 | | 0.293 |
| **5th layer (High-speed red-sensitive emulsion layer)** | | |
| Em-G | silver coating amt. | 0.228 |
| Gelatin | | 1.757 |
| ExC-1 | | 0.057 |
| ExC-2 | | 0.079 |
| ExC-3 | | 0.019 |
| ExC-5 | | 0.005 |
| Cpd-2 | | 0.044 |
| Solv-1 | | 0.165 |
| **6th layer (Interlayer)** | | |
| Gelatin | | 1.489 |
| Cpd-1 | | 0.069 |
| ExF-5 | | 0.074 |
| ExF-7 | | 0.062 |
| ExF-8 | | 0.028 |
| Solv-1 | | 0.223 |
| **7th layer (Low-speed green-sensitive emulsion layer)** | | |
| Em-F | silver coating amt. | 0.306 |
| Gelatin | | 1.614 |
| ExM-1 | | 0.164 |
| ExM-3 | | 0.095 |
| ExM-4 | | 0.148 |
| Solv-1 | | 0.499 |
| Solv-2 | | 0.050 |
| **8th layer (Medium-speed green-sensitive emulsion layer)** | | |
| Em-E | silver coating amt. | 0.187 |
| Gelatin | | 0.525 |
| ExM-1 | | 0.048 |
| ExM-2 | | 0.037 |
| ExM-3 | | 0.021 |
| ExM-4 | | 0.043 |
| Solv-1 | | 0.171 |
| Solv-2 | | 0.020 |
| **9th layer (High-speed green-sensitive emulsion layer)** | | |
| Em-D | silver coating amt. | 0.254 |
| Gelatin | | 0.447 |
| ExM-1 | | 0.040 |
| ExM-2 | | 0.031 |
| ExM-3 | | 0.018 |
| ExM-4 | | 0.036 |

-continued

| | | |
|---|---|---|
| Solv-1 | | 0.150 |
| Solv-2 | | 0.010 |
| 10th layer (Yellow filter layer) | | |
| Yellow colloidal silver | silver coating amt. | 0.064 |
| Gelatin | | 0.950 |
| Cpd-1 | | 0.105 |
| ExF-8 | | 0.028 |
| Solid disperse dye ExF-9 | | 0.125 |
| Solv-1 | | 0.121 |
| 11th layer (Low-speed blue-sensitive emulsion layer) | | |
| Em-C | silver coating amt. | 0.137 |
| Gelatin | | 1.514 |
| ExY-1 | | 0.056 |
| ExY-2 | | 0.561 |
| ExC-2 | | 0.008 |
| Solv-1 | | 0.234 |
| 12th layer (Medium-speed blue-sensitive emulsion layer) | | |
| Em-B | silver coating amt. | 0.149 |
| Gelatin | | 0.859 |
| ExY-1 | | 0.039 |
| ExY-2 | | 0.391 |
| ExC-3 | | 0.009 |
| Solv-1 | | 0.163 |
| 13th layer (High-speed blue-sensitive emulsion layer) | | |
| Em-A | silver coating amt. | 0.283 |
| Gelatin | | 0.371 |
| ExY-1 | | 0.010 |
| ExY-2 | | 0.101 |
| ExC-3 | | 0.003 |
| Solv-1 | | 0.042 |
| 14th layer (1st protective layer) | | |
| Silver iodobromide emulsion grain (average grain diameter 0.07 μm, silver iodide content 2 mol %) | silver coating amt. | 0.211 |
| Gelatin | | 0.683 |
| Solid disperse dye ExF-9 | | 0.054 |
| ExF-1 | | 0.073 |
| H-1 | | 0.160 |

-continued

| | |
|---|---|
| 15th layer (2nd protective layer) | |
| Gelatin | 0.727 |
| B-1 (diameter 2.0 μm) | 0.007 |
| B-2 (diameter 2.0 μm) | 0.005 |
| B-3 | 0.047 |
| H-1 | 0.170 |

In addition to the above components, 1,2-benzthiazoline-3-on (200 ppm based on a gelatin on average), n-butyl-p-hydroxy benzoate (about 1000 ppm based on the same above-mentioned), and 2-phenoxyethanol (about 10000 ppm based on the same above-mentioned) were added to sample 101.

Furthermore, Cpd-3 to Cpd-7, B-4, B-5, W-1 to W-13, F-1 to F-21, ExF-2, ExF-3, ExF-6, and UV-1 to UV-5 were added.

Preparation of Dispersions of Organic Solid Disperse Dyes

ExF-9 in the 10th layer and 14th layer was dispersed by the following method.

| | |
|---|---|
| Wet cake (containing 17.6 mass % of water) of ExF-9 | 1.210 kg |
| W-11 | 0.400 kg |
| F-15 | 0.006 kg |
| Water | 8.384 kg |
| Total | 10.000 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill, thereby obtaining a solid disperse dye ExF-9. The average grain size of the fine dye grains was 0.15 μm.

The structural formulas of material used in the above-mentioned photosensitive material will be described below.

Cmpound 1

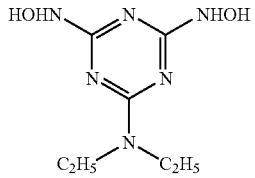

Cmpound 2

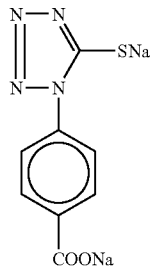

Cmpound 3

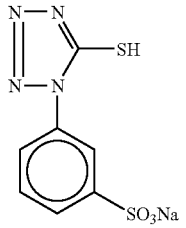

ExC-1

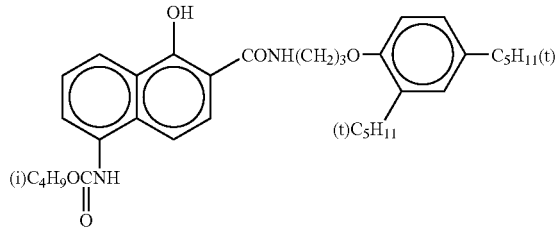

-continued
ExC-2
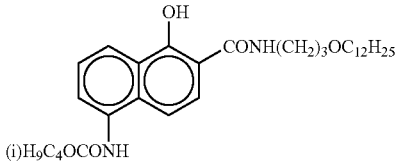
ExC-3
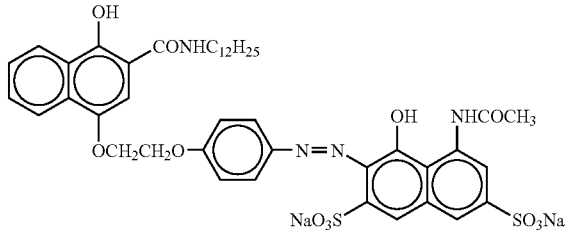
ExC-4
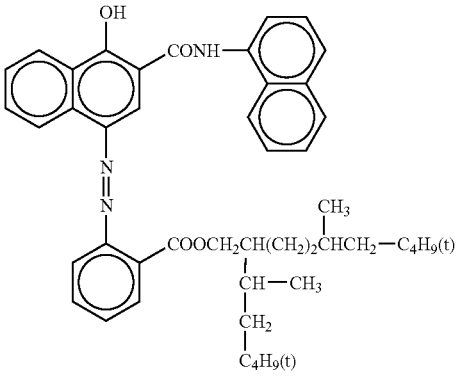
ExC-5
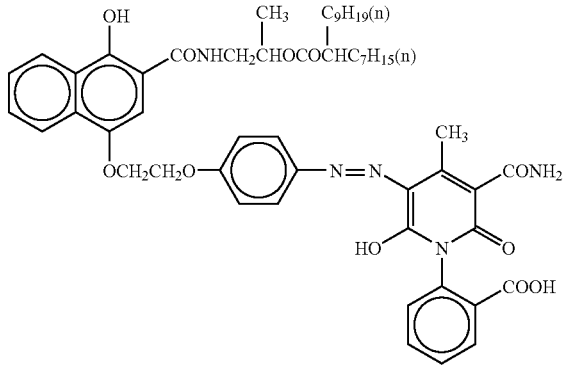
ExM-1
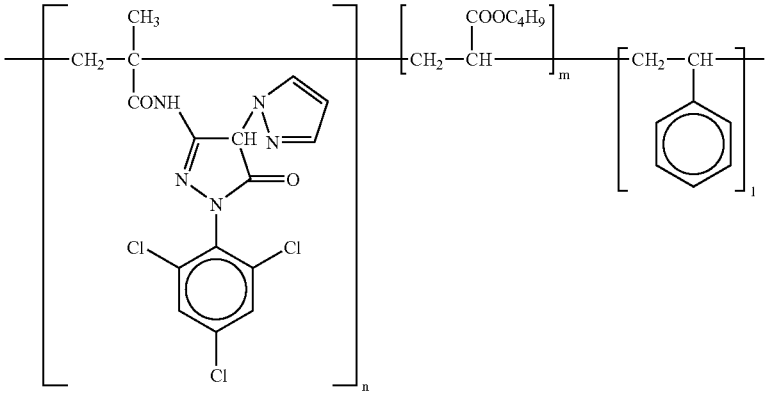
n:m:l = 2:1:1
(mass ratio)
av. mol. wt. 20,000
ExM-2
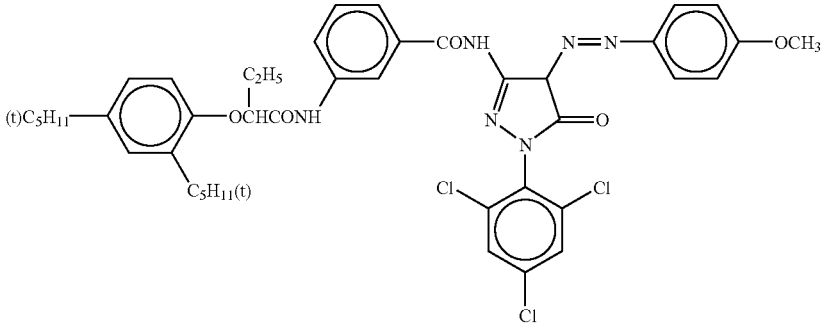

-continued
ExM-3
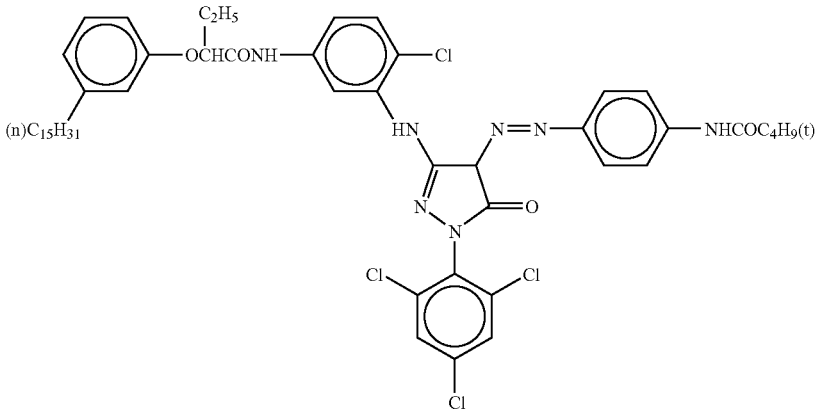
ExM-4
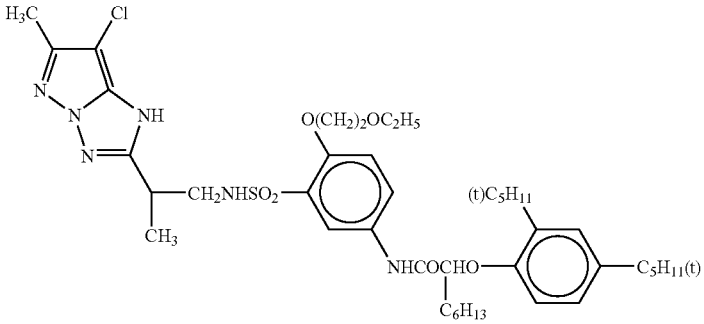
ExY-1
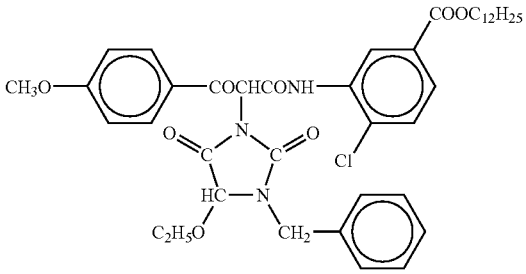
ExY-2
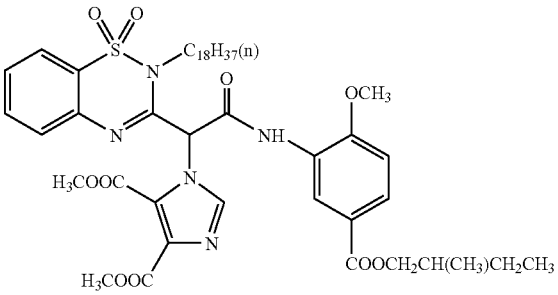
Solv-1
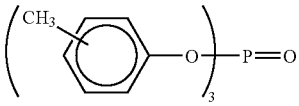
Solv-2
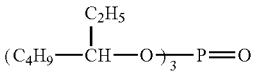
Cpd-1
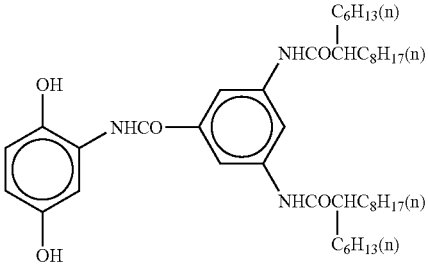
Cpd-2
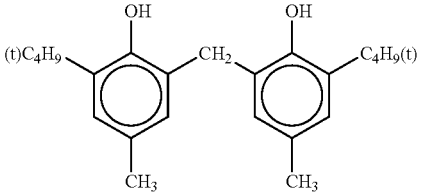

-continued
Cpd-3
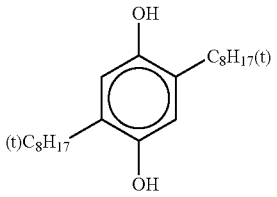
Cpd-4
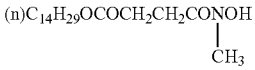
Cpd-5
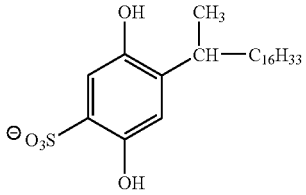
Cpd-6
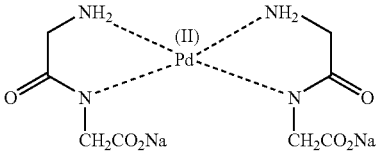
Cpd-7
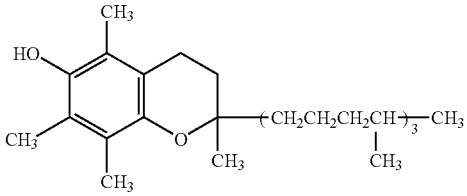
B-1
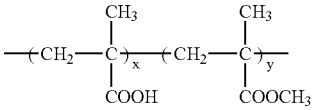
x/y = 10/90
B-2
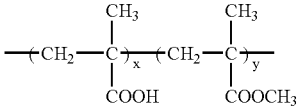
x/y = 40/60
B-3
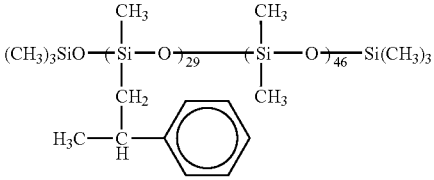
B-4
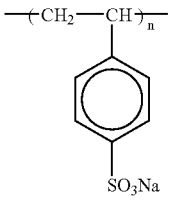
B-5
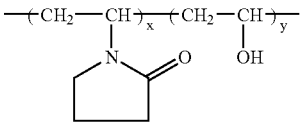
x/y = 70/30
UV-1
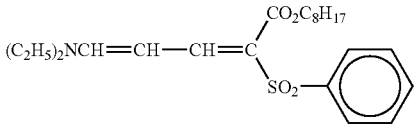
UV-2
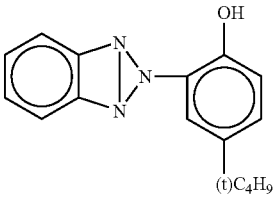
UV-3
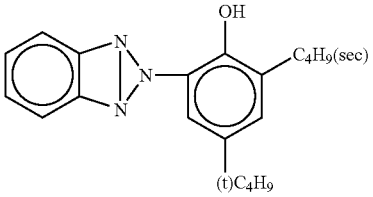
UV-4
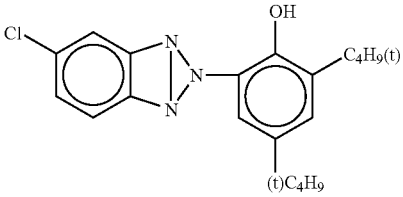
UV-5
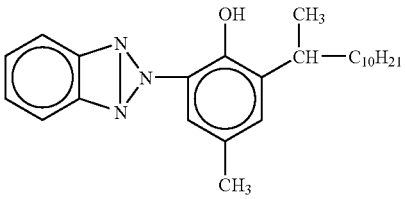
W-1
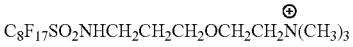

-continued
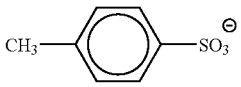
W-2
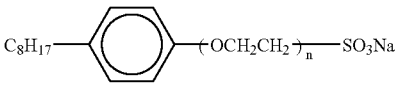
n = 2 to 4
W-3
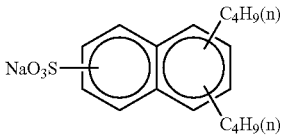
W-4
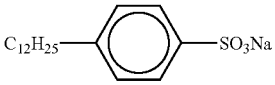
W-5
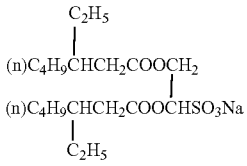
W-6
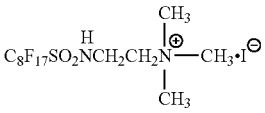
W-7
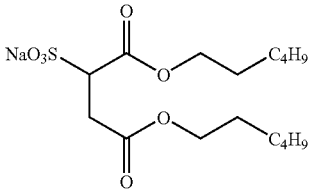
W-8
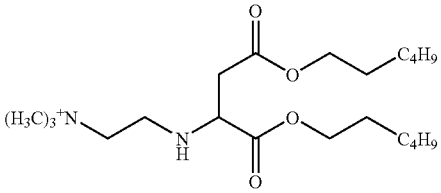
W-9
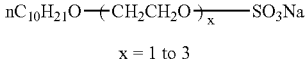
x = 1 to 3
W-10
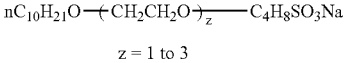
z = 1 to 3
W-11
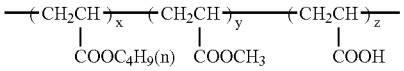
x/y/z = 20/60/20
(mass ratio)
av. mol. wt.: about 36,000
W-12
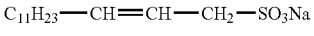
60%
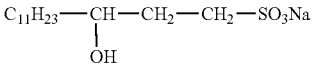
40%
W-13
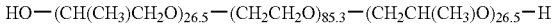
F-1
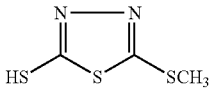
F-2
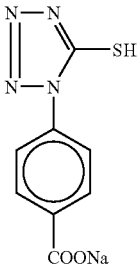
F-3
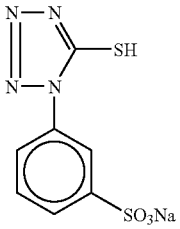
F-4
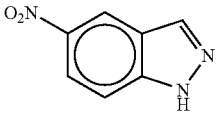
F-5
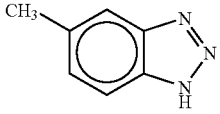
F-6
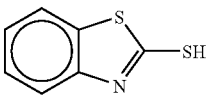

-continued
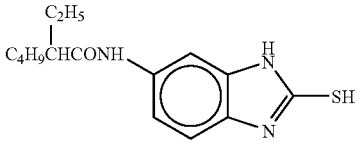
F-7
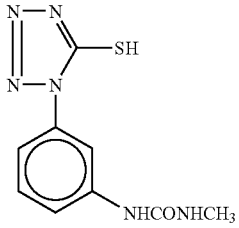
F-8
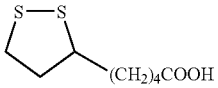
F-9
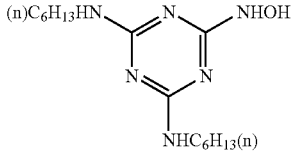
F-10
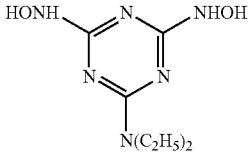
F-11
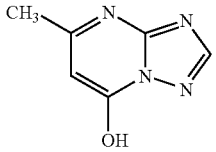
F-12
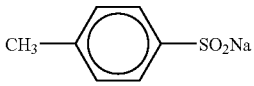
F-13
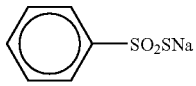
F-14
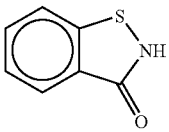
F-15
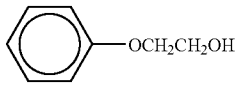
F-16
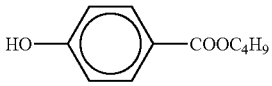
F-17
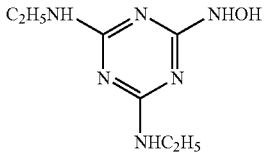
F-18
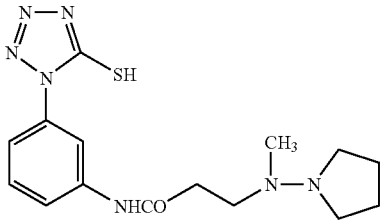
F-19
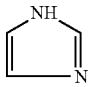
F-20
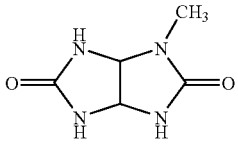
F-21
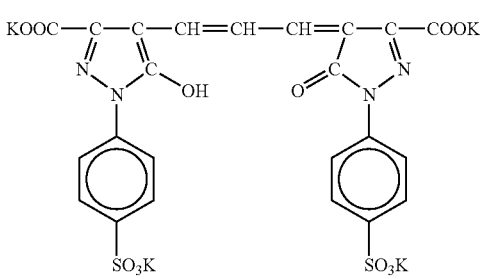
ExF-1

-continued
ExF-2
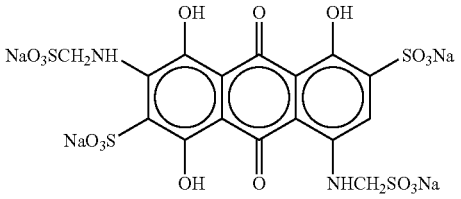
ExF-3
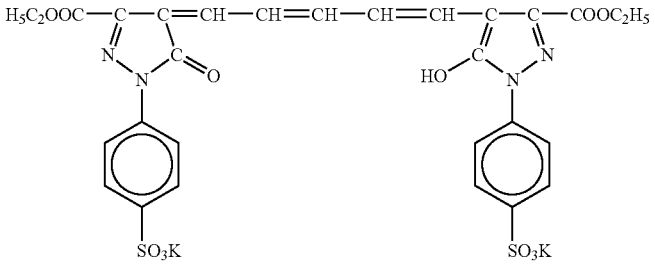
ExF-4
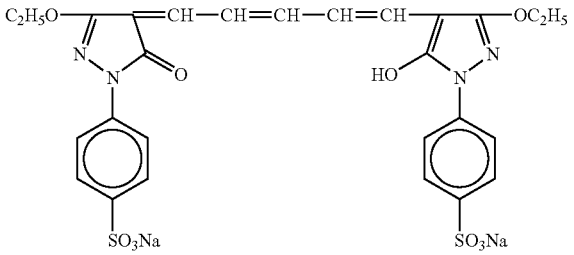
ExF-5
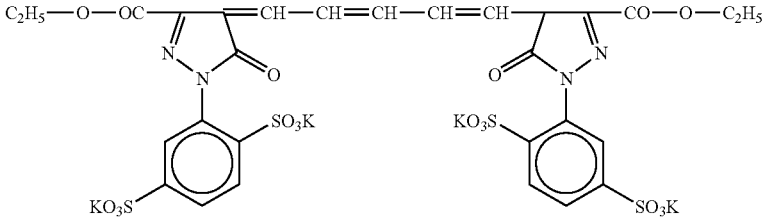
ExF-6
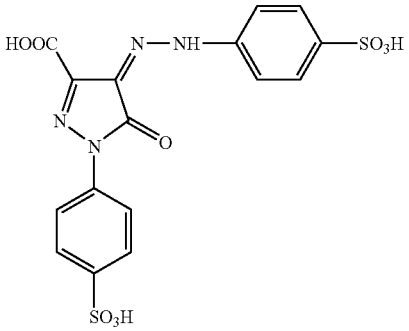
ExF-7
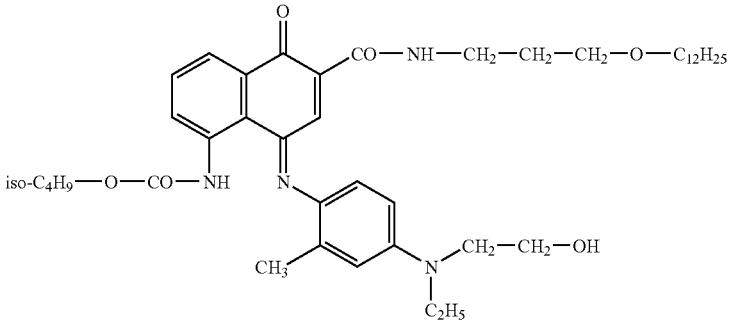

-continued

ExF-8

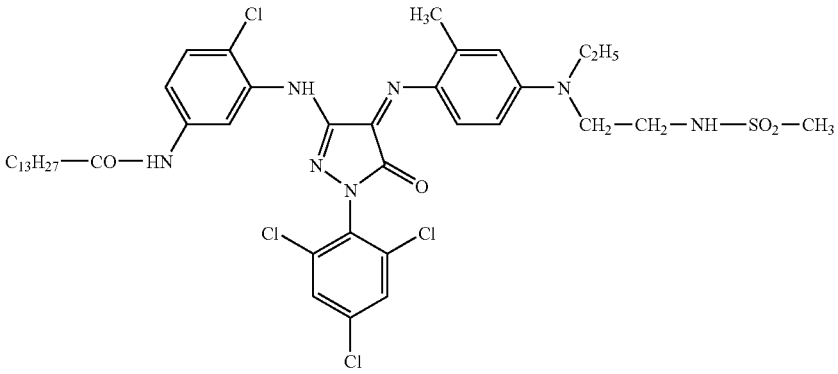

ExF-9

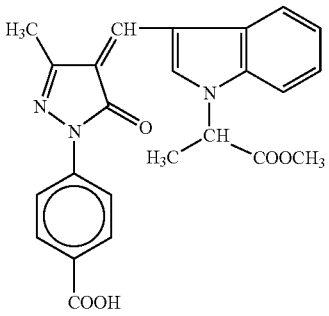

H-1

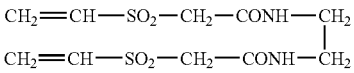

Sample 102 was prepared in the same manner as sample 101 except that the emulsions used in 3rd layer, 4th layer and 5th layer were changed to Em-(40), (42) and (44) respectively and that the emulsions used in 7th layer, 8th layer and 9th layer were changed to Em-(10), (20) and (30) respectively.

Sample 103 was prepared in the same manner as sample 102 except that the emulsions used in 7th layer, 8th layer and 9th layer were changed to Em-(11), (21) and (31) respectively.

Sample 104 was prepared in the same manner as sample 102 except that the emulsions used in 7th layer, 8th layer and 9th layer were changed to Em-(12), (22) and (32) respectively.

Sample 105 was prepared in the same manner as sample 102 except that the emulsions used in 7th layer, 8th layer and 9th layer were changed to Em-(13), (23) and (33) respectively.

Sample 106 was prepared in the same manner as sample 102 except that the emulsions used in 7th layer, 8th layer and 9th layer were changed to Em-(14), (24) and (34) respectively.

Sample 107 was prepared in the same manner as sample 102 except that the emulsions used in 7th layer, 8th layer and 9th layer were changed to Em-(15), (25) and (35) respectively.

Sample 108 was prepared in the same manner as sample 102 except that the emulsions used in 7th layer, 8th layer and 9th layer were changed to Em-(16), (26) and (36) respectively.

Sample 109 was prepared in the same manner as sample 102 except that the emulsions used in 7th layer, 8th layer and 9th layer were changed to Em-(17), (27) and (37) respectively.

Sample 110 was prepared in the same manner as sample 102 except that the emulsions used in 7th layer, 8th layer and 9th layer were changed to Em-(18), (28) and (38) respectively.

Sample 111 was prepared in the same manner as sample 106 except that the emulsions used in 11th layer, 12th layer and 13th layer were changed to Em-(1), (4) and (7) respectively.

Sample 112 was prepared in the same manner as sample 106 except that the emulsions used in 11th layer, 12th layer and 13th layer were changed to Em-(2), (5) and (8) respectively.

Sample 113 was prepared in the same manner as sample 106 except that the emulsions used in 11th layer, 12th layer and 13th layer were changed to Em-(3), (6) and (9) respectively.

Sample 114 was prepared in the same manner as sample 112 except that the emulsions used in 3rd layer, 4th layer and 5th layer were changed to Em-(41), (43) and (45) respectively.

Sample 115 was prepared in the same manner as sample 112 except that the emulsions used in 7th layer, 8th layer and 9th layer were changed to Em-(19), (29) and (39) respectively.

Sample 201 was prepared in the same manner as sample 102 except that the emulsions used in 7th layer, 8th layer and 9th layer were changed to Em-1, 8 and 15 respectively.

Sample 202 was prepared in the same manner as sample 102 except that the emulsions used in 7th layer, 8th layer and 9th layer were changed to Em-2, 9 and 16 respectively.

Sample 203 was prepared in the same manner as sample 102 except that the emulsions used in 7th layer, 8th layer and 9th layer were changed to Em-3, 10 and 17 respectively.

Sample 204 was prepared in the same manner as sample 102 except that the emulsions used in 7th layer, 8th layer and 9th layer were changed to Em-4, 11 and 18 respectively.

Sample 205 was prepared in the same manner as sample 102 except that the emulsions used in 7th layer, 8th layer and 9th layer were changed to Em-5, 12 and 19 respectively.

Sample 206 was prepared in the same manner as sample 102 except that the emulsions used in 7th layer, 8th layer and 9th layer were changed to Em-6, 13 and 20 respectively.

Sample 207 was prepared in the same manner as sample 102 except that the emulsions used in 7th layer, 8th layer and 9th layer were changed to Em-7, 14 and 21 respectively.

(Evaluation of Blotting Value k and Color Purity)

For evaluating the blotting and color purity, exposure of digital information of pixel account (2048×1556) at a size of 0.8×0.6 inch was performed with the use of a blue semiconductor laser, a green solid laser (YAG laser) and a red semiconductor laser having a peak wavelength of 460 nm, 532 nm and 660 nm, respectively, followed by development. The evaluation was carried out by the method shown in the specification. The results were shown in after-mentioned Table A.

The content of color development processing that developed the samples 101 to 115 is as follows:

| Processing step | Temperature (° C.) | Time |
|---|---|---|
| (1) Prebath | 27 ± 1 | 10 sec |
| (2) Removal of backing and rinsing with water by spray | 27 to 38 | 5 sec |
| (3) Color development | 41.1 ± 0.1 | 3 minutes |
| (4) Stoppage | 27 to 38 | 30 sec |
| (5) Rinsing with water | 27 to 38 | 30 sec |
| (6) Bleaching | 27 ± 1 | 3 minutes |
| (7) Rinsing with water | 27 to 38 | 1 minute |
| (8) Fixation | 38 ± 1 | 2 minutes |
| (9) Rinsing with water | 27 to 38 | 2 minutes |
| (10) Stabilization | 27 to 38 | 10 sec |

The prescription of processing solutions used at the respective processing steps is as follows:

| (Prescription of respective processing solutions) | Prescription value |
|---|---|
| (1) Prebath | |
| Water at 27 to 38° C. | 800 ml |
| Borax (decahydrate salt) | 20.0 g |
| Sodium sulfate (anhydrous) | 100 g |
| Sodium hydroxide | 1.0 g |
| Water is added to | 1.00 litter |
| pH (27° C.) | 9.25 |
| (2) Color development | |
| Water at 21 to 38° C. | 850 ml |
| ANTICALCIUM No. 4 by Kodak | 2.0 ml |
| Sodium sulfite (anhydrous) | 2.0 g |
| ANTIFOG No. 9 by Eastman | 0.22 g |
| Sodium bromide (anhydrous) | 1.20 g |
| Sodium carbonate (anhydrous) | 25.6 g |
| Sodium bicarbonate | 2.7 g |
| Color developing agent: 4-amino-3-methyl-N-ethyl-N-(β-methanesulfonamidoethyl)-aniline | 4.0 g |
| Water is added to | 1.00 litter |
| pH (27° C.) | 10.20 |

-continued

| (Prescription of respective processing solutions) | Prescription value |
|---|---|
| (3) Stoppage | |
| Water at 21 to 38° C. | 900 ml |
| 7.0 N sulfuric acid | 50 ml |
| Water is added to | 1.00 litter |
| PH (27° C.) | 0.9 |
| (4) Bleaching solution | |
| Water at 24 to 38° C. | 700 ml |
| PROXEL GXL | 0.07 ml |
| CHELATING AGENT No. 1 by Kodak | 24.2 g |
| 28% ammonium hydroxide | 30.0 ml |
| Ammonium bromide | 32.5 g |
| Glacial acetic acid | 10.0 ml |
| Ferric nitrate (nonahydrate salt) | 28.8 g |
| Water is added to | 1.00 litter |
| PH (27° C.) | 5.0 ± 0.2 |
| (5) Fixation | |
| Water at 20 to 38° C. | 700 ml |
| ANTICALCIUM No. 4 by Kodak | 2.0 ml |
| 58% ammonium thiosulfate solution | 185 ml |
| Sodium sulfite (anhydrous) | 10.0 g |
| Sodium bisulfite (anhydrous) | 8.4 g |
| Water is added to | 1.0 litter |
| pH (27° C.) | 6.5 |
| (6) Stabilization | |
| Water at 21 to 27° C. | 1.00 litter |
| STABILIZER ADDITIVE by Kodak | 0.14 ml |
| Formalin (37.5% solution) | 1.5 ml |

(Sensorial Evaluation)

The Sensorial evaluation of the image quality of the samples 101 to 115 was carried out by the following method.

A landscape image having digital information of pixel account (2048×1556) was exposed to the samples 101 to 115 at a size of 0.8×0.6 inch with the use of a blue semiconductor laser, a green solid laser (YAG laser) and a red semiconductor laser having a peak wavelength of 460 nm, 532 nm and 660 nm, respectively, and negative images obtained were projected and appreciated by 20 surveyors. Evaluation was carried out by a method of relatively evaluating the images, referring to an evaluation value of 3 (standard) at the time of using the sample 101 at pixel account (1024×778). Further, after exposure was carried out to a Fuji Color positive film F-CP using the negative image, development processing was carried out by the method described in the item of "Fuji Color, Processing of positive film" in FUJIFILM PROCESSING MANUAL Motion Picture Films, to obtain positive images. These images were projected and similarly evaluated.

Sharpness with respect to the negative images and sharpness and color saturation with respect to the positive images were evaluated at the below-mentioned seven stages and the average of the evaluation values of the 20 surveyors was calculated. The result is shown in Table A.

0: Very inferior

1: Inferior

2: Slightly inferior

3: (Standard)

4: Slightly superior

5: Superior

6: Very superior

TABLE A

| Expt No. | Sample | Peak wavelength (nm) of spectral sensitivity B | G | R | Blotting k/(D − 0.2)² Dmin + 1.0 B | G | R | Dmin + 2.0 B | G | R | Color purity (Dmax) (%) B | G | R | Sensorial evaluation Sharpness Neg. image | Pos. image | Color saturation Pos. image | Remarks |
|---|---|---|---|---|---|---|---|---|---|---|---|---|---|---|---|---|---|
| 1 | 101 | 471 | 573 | 630 | 5.4 | 5.6 | 5.1 | 5.8 | 5.9 | 5.3 | 70 | 73 | 70 | 3.0 | 3.0 | 3.0 | Comp. |
| 2 | 102 | 471 | 550 | 685 | 5.3 | 5.0 | 4.9 | 5.5 | 5.2 | 5.0 | 71 | 75 | 76 | 3.4 | 3.0 | 3.5 | Comp. |
| 3 | 103 | 471 | 542 | 685 | 5.0 | 4.3 | 4.8 | 5.2 | 4.5 | 5.0 | 71 | 81 | 76 | 4.3 | 4.2 | 4.3 | Inv. |
| 4 | 104 | 471 | 539 | 685 | 5.0 | 4.1 | 4.8 | 5.2 | 4.3 | 5.0 | 70 | 83 | 77 | 4.8 | 4.7 | 4.7 | Inv. |
| 5 | 105 | 471 | 537 | 685 | 5.0 | 3.8 | 4.8 | 5.2 | 4.0 | 5.0 | 75 | 85 | 78 | 5.0 | 5.0 | 5.0 | Inv. |
| 6 | 106 | 471 | 532 | 685 | 4.9 | 3.5 | 4.7 | 5.1 | 3.7 | 4.9 | 80 | 90 | 80 | 5.3 | 5.2 | 5.2 | Inv. |
| 7 | 107 | 471 | 527 | 685 | 4.9 | 3.7 | 4.8 | 5.1 | 3.9 | 5.0 | 76 | 86 | 79 | 5.1 | 5.0 | 5.0 | Inv. |
| 8 | 108 | 471 | 525 | 685 | 5.1 | 4.0 | 4.9 | 5.3 | 4.2 | 5.1 | 73 | 83 | 78 | 4.7 | 4.8 | 4.7 | Inv. |
| 9 | 109 | 471 | 522 | 685 | 5.0 | 4.3 | 4.9 | 5.2 | 4.4 | 5.1 | 72 | 81 | 76 | 4.5 | 4.4 | 4.4 | Inv. |
| 10 | 110 | 471 | 520 | 685 | 5.3 | 4.9 | 5.0 | 5.7 | 5.2 | 5.2 | 71 | 76 | 72 | 3.3 | 3.1 | 3.2 | Comp. |
| 11 | 111 | 465 | 532 | 685 | 4.2 | 3.4 | 4.7 | 4.4 | 3.6 | 5.0 | 83 | 91 | 80 | 5.5 | 5.4 | 5.5 | Inv. |
| 12 | 112 | 460 | 532 | 685 | 3.3 | 3.1 | 4.7 | 3.5 | 3.2 | 4.9 | 93 | 94 | 81 | 5.8 | 5.5 | 5.7 | Inv. |
| 13 | 113 | 455 | 532 | 685 | 4.1 | 3.3 | 4.6 | 4.3 | 3.5 | 4.8 | 84 | 91 | 80 | 5.5 | 5.3 | 5.4 | Inv. |
| 14 | 114 | 460 | 532 | 660 | 3.0 | 2.8 | 3.0 | 3.1 | 3.0 | 3.1 | 99 | 99 | 98 | 6.0 | 5.9 | 6.0 | Inv. |
| 15 | 115 | 460 | 533 | 660 | 3.1 | 3.0 | 3.2 | 3.3 | 3.2 | 3.4 | 98 | 96 | 97 | 5.8 | 5.7 | 5.9 | Inv. |

* Peak wavelength of blue light source (semiconductor laser): 460 nm
* Peak wavelength of green light source (solid laser (YAG laser)): 532 nm
* Peak wavelength of red light source (semiconductor laser): 660 nm It is found from Table A that projection image superior in sharpness and color saturation is obtained by adopting the image recording method of the invention.

Tests were carried out for the samples 106 and 201 to 207 in a similar manner as the above-mentioned method and blotting, color purity and sensorial evaluation were compared with respect to only the green photosensitive layer. The results are shown in Table B.

TABLE B

| Expt No. | Sample | Grain shape | Dye | Blotting k/(D − 0.2)² Dmin + 1.0 | Dmin + 2.0 | Color purity (Dmax) % | Sensorial evaluation Sharpness Neg. image | Pos. image | Color saturation Pos. image | Remarks |
|---|---|---|---|---|---|---|---|---|---|---|
| 1 | 201 | Octahedron | ExS-8* | 6.0 | 6.3 | 72.0 | 3.0 | 3.0 | 3.0 | Comp. |
| 2 | 202 | Octahedron | ExS-8*/ExS-6 | 5.9 | 6.2 | 75.0 | 3.4 | 3.2 | 3.0 | Comp. |
| 3 | 203 | Octahedron | ExS-7*/ExS-4 | 5.8 | 6.1 | 78.0 | 3.4 | 3.4 | 3.3 | Comp. |
| 4 | 204 | Octahedron | ExS-8*/ExS-7* | 4.3 | 4.5 | 87.0 | 4.9 | 4.9 | 5.0 | Inv. |
| 5 | 205 | Cube | ExS-8* | 5.6 | 5.9 | 73.0 | 3.1 | 3.2 | 3.1 | Comp. |
| 6 | 206 | Cube | ExS-8*/ExS-6 | 5.2 | 5.3 | 76.0 | 3.2 | 3.4 | 3.3 | Comp. |
| 7 | 207 | Cube | ExS-7*/ExS-4 | 5.0 | 5.2 | 78.0 | 3.4 | 3.5 | 3.4 | Comp. |
| 8 | 106 | Cube | ExS-8*/ExS-7* | 3.5 | 3.7 | 90.0 | 5.4 | 5.3 | 5.4 | Inv. |

*ExS-8: Sensitizing dye (A)
ExS-7: Sensitizing dye (B)

It is found from Table B that when the invention using the sensitization dyes (A) and (B) in combination is adopted, a projected image superior in sharpness and color saturation can be obtained.

What is claimed is:

1. A silver halide photosensitive material comprising at least one blue-sensitive layer, at least one green-sensitive layer and at least one red-sensitive layer on a transparent support, wherein a peak wavelength of spectral sensitivity of at least one of the green-sensitive layer is in the range of −10 nm or more and +10 nm or less in comparison with a peak wavelength of a green light source for exposure.

2. The silver halide photosensitive material according to claim 1, wherein the green light source for exposure is a solid laser, and the peak wavelength of spectral sensitivity of at least one of the green-sensitive layer is in the range of −10 nm or more and +10 nm or less in comparison with a peak wavelength of the solid laser.

3. The silver halide photosensitive material according to claim 1, wherein a peak wavelength of spectral sensitivity of at least one of the blue-sensitive layer is in the range of −10 nm or more and +10 nm or less in comparison with a peak wavelength of a blue light source for exposure.

4. The silver halide photosensitive material according to claim 1, wherein a peak wavelength of spectral sensitivity of at least one of the red photosensitive layer is in the range of −10 nm or more and +10 nm or less in comparison with a peak wavelength of a red light source for exposure.

5. A silver halide photosensitive material comprising at least one blue-sensitive layer, at least one green-sensitive layer and at least one red-sensitive layer on a transparent support, wherein a compound represented by the following general formula (A) and a compound represented by the following general formula (B) are contained in at least one of the green-sensitive layer:

General formula (A)

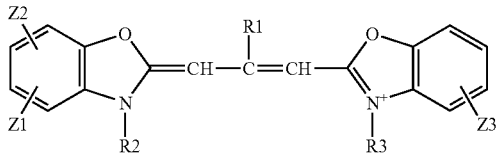

(X1)

General formula (B)

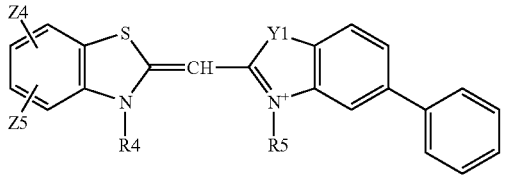

(X2)

in the general formula (A), R1 represents a hydrogen atom, an alkyl group or an aryl group; each of R2 and R3 represents an alkyl group; each of Z1 and Z2 represents a hydrogen atom, a halogen atom, a hydroxyl group, an alkoxy group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, Z1 and Z2 may be the same substituent or may be different substituents, and Z1 and Z2 may be bonded to each other to thereby form a ring; Z3 represents a halogen atom; and X1 represents a cationic counter ion for neutralizing electric charge if necessary;

in the general formula (B), Y1 represents sulfur or an oxygen atom; each of R4 and R5 represents an alkyl group; each of Z4 and Z5 represents a hydrogen atom, a halogen atom, a hydroxyl group, an alkoxy group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, Z4 and Z5 may be the same substituent or may be different substituents, and Z4 and Z5 may be bonded to each other to thereby form a ring; and X2 represents a cationic counter ion for neutralizing electric charge if necessary.

6. The silver halide photosensitive material according to claim 5, wherein the molar ratio of the compound represented by the general formula (A) to the compound represented by the general formula (B) contained in the green-sensitive layer satisfies the following formula (II):

$$0.5 \leqq [A]/[B] \leqq 2.0 \quad \text{(II)}$$

where [A] and [B] represents the number of moles (mol/mol Ag) of the compounds represented respectively by the general formulae (A) and (B) per mole of silver halide that is contained in the green-sensitive layer in which the compounds represented by the general formulae (A) and (B) are contained.

7. The silver halide photosensitive material according to claim 5, wherein the shape of silver halide grains contained in the green-sensitive layer containing the compounds represented by the general formulae (A) and (B) is cubic.

8. The silver halide photosensitive material according to claim 1, wherein digital image information can be recorded with little deterioration at image formation in which the digital image information is recorded at a resolution of 2000 dpi or more.

9. The silver halide photosensitive material according to claim 5, wherein digital image information can be recorded with little deterioration at image formation in which the digital image information is recorded at a resolution of 2000 dpi or more.

10. The silver halide photosensitive material according to claim 1, wherein digital image information with 3 million or more pixels can be recorded with little deterioration.

11. The silver halide photosensitive material according to claim 5, wherein digital image information with 3 million or more pixels can be recorded with little deterioration.

12. The silver halide photosensitive material according to claim 1, wherein blotting k of the image at image recording satisfies the following formula (I):

$$k \leqq 4.5 \times (D-0.2)^2 \quad \text{(I)}$$

wherein in formula (I);

D: Color density of the silver halide photosensitive material,

Blotting k: blotting (μm) at color density D.

13. The silver halide photosensitive material according to claim 5, wherein blotting k of the image at image recording satisfies the following formula (I):

$$k \leqq 4.5 \times (D-0.2)^2 \quad \text{(I)}$$

wherein in formula (I);

D: Color density of the silver halide photosensitive material,

Blotting k: blotting (μm) at color density D.

14. The silver halide photosensitive material according to claim 1, wherein color purity rate is 80% or more in color reproduction at image recording.

15. The silver halide photosensitive material according to claim 5, wherein color purity rate is 80% or more in color reproduction at image recording.

16. An image forming method, wherein digital image information recorded in the silver halide photosensitive material according to claim 1 is further recorded on the silver halide photosensitive material by an analog system.

17. An image forming method, wherein digital image information recorded in the silver halide photosensitive material according to claim 5 is further recorded on the silver halide photosensitive material by an analog system.

* * * * *